US008600443B2

(12) United States Patent
Kawaguchi et al.

(10) Patent No.: US 8,600,443 B2
(45) Date of Patent: Dec. 3, 2013

(54) SENSOR NETWORK SYSTEM FOR ACQUIRING HIGH QUALITY SPEECH SIGNALS AND COMMUNICATION METHOD THEREFOR

(75) Inventors: Hiroshi Kawaguchi, Kobe (JP); Masahiko Yoshimoto, Kobe (JP); Shintaro Izumi, Kobe (JP)

(73) Assignee: Semiconductor Technology Academic Research Center, Kanagawa (JP)

( * ) Notice: Subject to any disclaimer, the term of this patent is extended or adjusted under 35 U.S.C. 154(b) by 0 days.

(21) Appl. No.: 13/547,426

(22) Filed: Jul. 12, 2012

(65) Prior Publication Data

US 2013/0029684 A1 Jan. 31, 2013

(30) Foreign Application Priority Data

Jul. 28, 2011 (JP) ..... 2011-164986

(51) Int. Cl.
*H04B 1/38* (2006.01)

(52) U.S. Cl.
USPC . 455/563; 455/570; 379/420.01; 379/202.01; 379/388.01; 381/97; 381/17

(58) Field of Classification Search
None
See application file for complete search history.

(56) References Cited

U.S. PATENT DOCUMENTS

| | | | | |
|---|---|---|---|---|
| 6,195,046 | B1 * | 2/2001 | Gilhousen | 342/457 |
| 2006/0023871 | A1 * | 2/2006 | Shaffer et al. | 379/420.01 |
| 2006/0221769 | A1 * | 10/2006 | Van Loenen et al. | 367/99 |
| 2009/0262604 | A1 | 10/2009 | Funada | |
| 2010/0008515 | A1 * | 1/2010 | Fulton et al. | 381/92 |
| 2010/0191525 | A1 * | 7/2010 | Rabenko et al. | 704/211 |

FOREIGN PATENT DOCUMENTS

| | | |
|---|---|---|
| JP | 2008-58342 | 3/2008 |
| JP | 2008-99075 | 4/2008 |
| JP | 2008-113164 | 5/2008 |
| WO | 2008/026463 | 3/2008 |

OTHER PUBLICATIONS

Ralph O. Schmidt, "Multiple Emitter Location and Signal Parameter Estimation", IEEE Transactions on Antennas and Propagation, vol. AP-34, No. 3, Mar. 1986, pp. 276-280.

Eugene Weinstein et al., "LOUD: A 1020-Node Modular Microphone Array and Beamformer for Intelligent Computing Spaces", MIT, MIT/LCS Technical Memo MIT-LCS-TM-642, Apr. 2004, pp. 1-18.

(Continued)

*Primary Examiner* — Rafael Pérez-Gutiérrez
*Assistant Examiner* — Keith Fang
(74) *Attorney, Agent, or Firm* — Wenderoth, Lind & Ponack, L.L.P.

(57) ABSTRACT

A sensor network system including node devices connected in a network via predetermined propagation paths collects data measured at each node device to be aggregated into one base station via a time-synchronized sensor network system. The base station calculates a position of the signal source based on the angle estimation value of the signal from each node device and position information thereof, designates a node device located nearest to the signal source as a cluster head node device, and transmits information of the position of the signal source and the designated cluster head node device to each node device, to cluster each node device located within the number of hops from the cluster head node device as a node device belonging to each cluster. Each node device performs an emphasizing process on the received signal from the signal source, and transmits an emphasized signal to the base station.

6 Claims, 21 Drawing Sheets

(56) References Cited

OTHER PUBLICATIONS

Alessio Brutti et al., "Classification of Acoustic Maps to Determine Speaker Position and Orientation from a Distributed Microphone Network", In Proceedings of ICASSP, vol. IV, Apr. 2007, pp. 493-496.
Wendi Rabiner Heinzelman et al., "Energy-Efficient Communication Protocol for Wireless Microsensor Networks", Proceedings of the 33rd Hawaii International Conference on System Sciences-2000, vol. 8, Jan. 2000, pp. 1-10.
Vivek Katiyar et al., "A Survey on Clustering Algorithms for Heterogeneous Wireless Sensor Networks", International Journal of Advanced Networking and Applications, vol. 02, Issue 04, 2011, pp. 745-754.
Jacob Benesty et al., "Springer Handbook of Speech Processing", Springer, 50. Microphone Arrays, 2008, pp. 1021-1041.
Futoshi Asano et al., "Sound Source Localization and Signal Separation for Office Robot "Jijo-2"", Proceedings of the 1999 IEEE International Conference on Multisensor Fusion and Integration for Intelligent Systems, Taipei, Taiwan, R.O.C., Aug. 1999, pp. 243-248.
Miklós Maróti et al., "The Flooding Time Synchronization Protocol", Proceedings of 2nd ACM SenSys, Nov. 2004, pp. 39-49.
Takashi Takeuchi et al., "Cross-Layer Design for Low-Power Wireless Sensor Node Using Wave Clock", IEICE Transactions on Communications, vol. E91-B, No. 11, Nov. 2008, pp. 3480-3488.
Maleq Khan et al., "Distributed Algorithms for Constructing Approximate Minimum Spanning Trees in Wireless Sensor Networks", IEEE Transactions on Parallel and Distributed Systems, vol. 20, No. 1, Jan. 2009, pp. 124-139.
Wei Ye et al., "Medium Access Control With Coordinated Adaptive Sleeping for Wireless Sensor Networks", IEEE/ACM Transactions on Networking, vol. 12, No. 3, Jun. 2004, pp. 493-506.

* cited by examiner

Fig.24

TABLE MEMORY IN PARAMETER MEMORY 57b

| TYPE | DATA | | ACQUIRED TIMING |
|---|---|---|---|
| SELF-NODE DEVICE INFORMATION | NODE DEVICE ID | | PREDETERMINED |
| | XY COORDINATES | | |
| PATH INFORMATION | TRANSMISSION DESTINATION NODE DEVICE ID (BASE STATION DIRECTION) | | ACQUIRED AT T11 |
| | TRANSMISSION DESTINATION NODE DEVICE ID (CLUSTER CL1) | | ACQUIRED AT T13 |
| | TRANSMISSION DESTINATION NODE DEVICE ID (CLUSTER CL2) | | |
| | ... | | |
| | TRANSMISSION DESTINATION NODE DEVICE ID (CLUSTER CLN) | | |
| CLUSTER INFORMATION | CLUSTER HEAD NODE DEVICE ID (CLUSTER CL1) | XY COORDINATES OF SPEECH SOURCE SS1 | ACQUIRED AT T13 AND T14 |
| | CLUSTER HEAD NODE DEVICE ID (CLUSTER CL2) | XY COORDINATES OF SPEECH SOURCE SS2 | |
| | ... | ... | |
| | CLUSTER HEAD NODE DEVICE ID (CLUSTER CLN) | XY COORDINATES OF SPEECH SOURCE SSN | |

FTSP AND ROUTING FROM BASE STATION (T11)

VA DETECTION AND DETECTION MESSAGE (T12)

WAKEUP MESSAGE AND CLUSTERING (T13)

DELAY-SUM IS PERFORMED BY SELECTING CLUSTER (T14)

NODE DEVICE N0 (BASE STATION)
N1
N2
N3
N4
N5
N6
N7
N8
SPANNING TREE IS CONSTITUTED AND FTSP MESSAGE IS BROADCASTED (PREDETERMINED CYCLE) FROM BASE STATION
t
T11
T12
T13
SLEEP MODE
VAD
WAKEUP MODE
SPEECH SOURCE DIRECTION ESTIMATING PROCESS
DETECTION MESSAGE IS TRANSMITTED TO BASE STATION
WAKEUP MESSAGE IS BROADCASTED VIA ONE HOP
A
B
C
D
E
F
G
H
I

SENSOR NETWORK SYSTEM FOR ACQUIRING HIGH QUALITY SPEECH SIGNALS AND COMMUNICATION METHOD THEREFOR

BACKGROUND OF THE INVENTION

1. Field of the Invention

The present invention relates to a sensor network system such as a microphone array network system which is provided for acquiring a speech of a high sound quality and a communication method therefor.

2. Description of the Related Art

Conventionally, in an application system (e.g., an audio teleconference system in which a plurality of microphones are connected, a speech recognition robot system, a system having various speech interfaces), which utilizes a vocal sound, various speech processing practices of speech source localization, speech source separation, noise cancellation, echo cancellation and so on are performed to utilize the vocal sound with a high sound quality. In particular, microphone arrays mainly intended for the processing of speech source localization and speech source separation are broadly researched for the purpose of acquiring a vocal sound with a high sound quality. In this case, the speech source localization specifies the direction and position of a speech source from sound arrival time differences, and the speech source separation is to extract a specific speech source in a specific direction by erasing sound sources that become noises by utilizing the results of speech source localization.

It has been known that the speech processing using microphone arrays normally improves its speech processing performance of noise processing and the like with an increased number of microphones. Moreover, in such speech processing, there is a number of speech source localization techniques using the position information of a speech source (See, for example, a Non-Patent Document 1). The speech processing becomes more effective as the results of speech source localization have better accuracy. In other words, it is required to concurrently improve the accuracy of the speech source localization and the noise cancellation intended for higher sound quality by increasing the number of microphones.

In a speech source localization method using a conventional large-scale microphone array, the positional range of a speech source is divided into positional ranges in a shape of mesh, and the speech source positions are stochastically calculated for respective intervals. For this calculation, there has been the practice of collecting all speech data in a speech processing server such as a work stations in one place and collectively processing all the speech data to estimate the position of the speech source (See, for example, a Non-Patent Document 2). In the case of the collective processing of all speech data as described above, the signal wiring length and communication traffic between the microphones for vocal sound collection and the speech processing server, and the calculation amount in the speech processing server have been vast. There is such a problem that the microphones cannot be increased in number due to the following:

(a) the increase in the wiring length, the communication traffic and the calculation amount in the speech processing server, and;

(b) such a physical limitation that a number of A/D converters cannot be arranged in one place of the speech processing server.

Moreover, there is also such a problem of occurrence of noises due to the increase in the signal wiring length. Therefore, there occurred a problem of difficulties in increasing the number of microphones intended for higher sound quality.

As a method for making improvements concerning the above problems, there has been known a speech processing system with a microphone array in which a plurality of microphones are grouped into small arrays and they are aggregated (See, for example, a Non-Patent Document 3). However, even in such a speech processing system, the speech data of all the microphones obtained in small arrays are aggregated into the speech server in one place via a network, and therefore, this leads to a problem of increase in the communication traffic of the network. Moreover, there is such a problem that a speech processing delay occurs in accordance with the increase in the communication data amount and the communication traffic amount.

Moreover, in order to satisfy demands for sound pickup in a ubiquitous system and a television conference system in the future, a greater number of microphones are necessary (See, for example, the Patent Document 1). However, in the current network system with a microphone array as described above, the speech data obtained by the microphone array is merely transmitted to the server as it is. We found out no system in which node devices of a microphone array mutually exchange position information of the speech source to reduce the calculation amount of the calculation amount in the entire system and reduce the communication traffic of the network. Therefore, a system architecture becomes important which reduces the calculation amount of the entire system and suppresses the communication traffic of the network by assuming an increase in the scale of the microphone array network system.

As described above, it has been demanded to improve the speech source localization accuracy by using a number of microphone arrays with suppressing the communication traffic and the calculation amount in the speech processing server and to effectively perform the speech processing of noise cancellation and so on. Moreover, a position measurement system using a speech source is proposed in these latter days. For example, the Patent Document 2 discloses computation of an ultrasonic tag by using an ultrasonic tag and a microphone array. Further, the Patent Document 3 discloses sound pickup by using a microphone array.

Prior art documents related to the present invention are as follows:

PATENT DOCUMENTS

Patent Document 1: Japanese patent laid-open publication No. JP 2008-113164 A; and Patent Document 2: Pamphlet of International Publication No. WO 2008/026463 A1;

Patent Document 3: Japanese patent laid-open publication No. JP 2008-058342 A; and Patent Document 4: Japanese patent laid-open publication No. JP 2008-099075 A.

NON-PATENT DOCUMENTS

Non-Patent Document 1: Ralph O. Schmidt, "Multiple emitter location and signal parameter estimation", In Proceedings of IEEE Transactions on Antennas and Propagation, Vol. AP-34, No. 3, March 1986.

Non-Patent Document 2: Eugene Weinstein et al., "Loud: A 1020-node modular microphone array and beamformer for intelligent computing spaces", MIT, MIT/LCS Technical Memo MIT-LCS-TM-642, April 2004.

Non-Patent Document 3: Alessio Brutti et al., "Classification of Acoustic Maps to Determine Speaker Position and Orientation from a Distributed Microphone Network", In Proceedings of ICASSP, Vol. IV, pp. 493-496, April. 2007.

Non-Patent Document 4: Wendi Rabiner Heinzelman et al., "Energy-Efficient Communication Protocol for Wireless Microsensor Networks", Proceedings of the 33rd Hawaii International Conference on System Sciences, 2000, Vol. 8, pp. 1-10, January 2000.

Non-Patent Document 5: Vivek Katiyar et al., "A Survey on Clustering Algorithms for Heterogeneous Wireless Sensor Networks", International Journal of Advanced Networking and Applications, Vol. 02, Issue 04, pp. 745-754, 2011.

Non-Patent Document 6: J. Benesty et al., "Springs Handbook of Speech Processing", Springer, 50. Microphone arrays, pp. 1021-1041, 2008.

Non-Patent Document 7: Futoshi Asano et al., "Sound Source Localization and Signal Separation for Office Robot "Jijo-2"", Proceedings of the 1999 IEEE International Conference on Multisensor Fusion and Integration for Intelligent Systems, Taipei, Taiwan, R.O.C., pp. 243-248, August 1999.

Non-Patent Document 8: Miklos Maroti et al., "The Flooding Time Synchronization Protocol", Proceedings of 2nd ACM SenSys, pp. 39-49, November 2004.

Non-Patent Document 9: Takashi Takeuchi et al., "Cross-Layer Design for Low-Power Wireless Sensor Node Using Wave Clock", IEICE Transactions on Communications, Vol. E91-B, No. 11, pp. 3480-3488, November 2008.

Non-Patent Document 10: Maleq Khan et al., "Distributed Algorithms for Constructing Approximate Minimum Spanning Trees in Wireless Networks", IEEE Transactions on Parallel and Distributed Systems, Vol. 20, No 1, pp. 124-139, January 2009.

Non-Patent Document 11: Wei Ye et al., "Medium Access Control With Coordinated Adaptive Sleeping for Wireless Sensor Networks", In proceedings of IEEE/ACM Transactions on Networking, Vol. 12, No. 3, pp. 493-506, 2004.

However, the position measurement function of the GPS system and the WiFi system mounted on many mobile terminals had such a problem that a positional relation between terminals at a short distance of tens of centimeters cannot be acquired even though a rough position on a map can be acquired.

For example, the Non-Patent Document 4 discloses a communication protocol to perform wireless communications by efficiently using transmission energy in a wireless sensor network. Moreover, the Non-Patent Document 5 discloses using a clustering technique for lengthening the lifetime of the sensor network as a method for reducing the energy consumption in a wireless sensor network.

However, the prior art clustering method, which is a technique limited to a network layer, considers neither the sensing object (application layer) nor the hardware configuration of node devices. This led to such a problem that the prior art technique is not adapted to an application that needs to configure paths based on the actual physical signal source position.

SUMMARY OF THE INVENTION

An object of the present invention is to solve the aforementioned problems and provide a sensor network system capable of performing data aggregation more efficiently than in the prior art, remarkably reducing the network traffic and reducing the power consumption of the sensor node devices in a sensor network system of, for example, a microphone array network system, and a communication method therefor.

In order to achieve the aforementioned objective, according to one aspect of the present invention, there is provided a sensor network system including a plurality of node devices each having a sensor array and known position information. The node devices are connected with each other in a network via predetermined propagation paths by using a predetermined communication protocol, and the sensor network system collects data measured at each of the node devices so as to be aggregated into one base station by using a time-synchronized sensor network system. Each of the node devices includes a sensor, a direction estimation processor part, and a communication processor part. The sensor array is configured to arrange a plurality of sensors in an array form. The direction estimation processor part operates when detecting a signal from a predetermined signal source received by the sensor array on the basis of the signal, to transmit a detected message to the base station and to estimate an arrival direction angle of the signal and transmit an angle estimation value to the base station, and is activated in response to an activation message at a time of detecting a signal received via a predetermined number of hops from other node devices to estimate an arrival direction angle of the signal and transmit an angle estimation value to the base station. The communication processor part performs an emphasizing process on a signal from a predetermined signal source received by the sensor array for each of the node devices belonging to a cluster designated by the base station in correspondence with the speech source, and transmits a signal that has undergone the emphasizing process to the base station. The base station calculates a position of the signal source on the basis of the angle estimation value of the signal from each of the node devices and position information of each of the node devices, designates a node device located nearest to the signal source as a cluster head node device, and transmits information of the position of the signal source and the designated cluster head node device to each of the node devices, thereby clustering each of the node devices located within the number of hops from the cluster head node device as a node belonging to each cluster. Each of the node devices performs an emphasizing process on the signal from the predetermined signal source received by the sensor array for each of the node devices belonging to the cluster designated by the base station in correspondence with the speech source, and transmits the signal that has undergone the emphasizing process to the base station.

In the above-mentioned sensor network system, each of the node devices is set into a sleep mode before detecting the signal and before receiving the activation message, and power supply to circuits other than a circuit that detects the signal and a circuit that receives the activation message are stopped.

In addition, in the above-mentioned sensor network system, the sensor is a microphone to detect a speech.

According to another aspect of the present invention, there is provide a communication method for use in a sensor network system including a plurality of node devices each having a sensor array and known position information. The node devices are connected with each other in a network via predetermined propagation paths by using a predetermined communication protocol, and the sensor network system collects data measured at each of the node devices so as to be aggregated into one base station by using a time-synchronized sensor network system. Each of the node devices includes a sensor array, a direction estimation processor part, and a communication processor part. The sensor array is configured to arrange a plurality of sensors in an array form. The direction estimation processor part operates when detecting a signal from a predetermined signal source received by the sensor array on the basis of the signal, to transmit a detected message to the base station and to estimate an arrival direction angle of the signal and transmit an angle estimation value to the base station and is activated in response to an activation message at a time of detecting a signal received via a predetermined number of hops from other node devices to estimate an arrival direction angle of the signal and transmit an angle estimation value to the base station. The communication processor part performs an emphasizing process on a signal from a predetermined signal source received by the sensor array for each of the node devices belonging to a cluster designated by the base station in correspondence with the speech source, and transmits a signal that has undergone the emphasizing process to the base station. The communication method including the following steps:

calculating by the base station a position of the signal source on the basis of the angle estimation value of the signal from each of the node devices and position information of each of the node devices, designating a node device located nearest to the signal source as a cluster head node device, and transmitting information of the position of the signal source and the designated cluster head node device to each of the node devices, thereby clustering each of the node devices located within the number of hops from the cluster head node device as a node device belonging to each cluster, and performing an emphasizing process by each of the node devices on the signal from the predetermined signal source received by the sensor array for each of the node devices belonging to the cluster designated by the base station in correspondence with the speech source, and transmitting the signal that has undergone the emphasizing process to the base station.

The above-mentioned communication method further includes a step of setting each of the node devices into a sleep mode before detecting the signal and before receiving the activation message, and stopping power supply to circuits other than a circuit that detects the signal and a circuit that receives the activation message.

In addition, in the above-mentioned communication method, the sensor is a microphone to detect a speech.

Therefore, according to the sensor network system and the communication method therefor of the present invention, by configuring the network paths specialized for data aggregation coping with the physical arrangement of a plurality of signal sources by utilizing the signal of the object of sensing for the clustering, cluster head determination, and routing on the sensor network, redundant paths are reduced, and the efficiency of data aggregation can be improved at the same time. Moreover, by virtue of the reduced communication overhead for configuring the paths, the network traffic is reduced, and the operating time of the communication circuit of large power consumption can be reduced. Therefore, the data aggregation can be performed more efficiently, the network traffic can be remarkably reduced, and the power consumption of the sensor node device can be reduced in the sensor network system by comparison to the prior art.

BRIEF DESCRIPTION OF THE DRAWINGS

These and other objects and features of the present invention will become clear from the following description taken in conjunction with the preferred embodiments thereof with reference to the accompanying drawings throughout which like parts are designated by like reference numerals, and in which:

FIG. 24 is a table showing a detailed configuration of a table memory in the parameter memory 57*b* of FIG. 23;

FIGS. 25A to 25D are schematic plan views showing processing operations of the data aggregation system of FIG. 22, in which FIG. 25A is a schematic plan view showing FTSP processing from the base station and routing (T11), FIG. 25B is a schematic plan view showing speech activity detection (VAD) and detection message transmission (T12), FIG. 25C is a schematic plan view showing wakeup message and clustering (T13), and FIG. 25D is a schematic plan view showing cluster selection and delay-sum processing (T14);

DETAILED DESCRIPTION OF THE PREFERRED EMBODIMENTS

Figure 1:
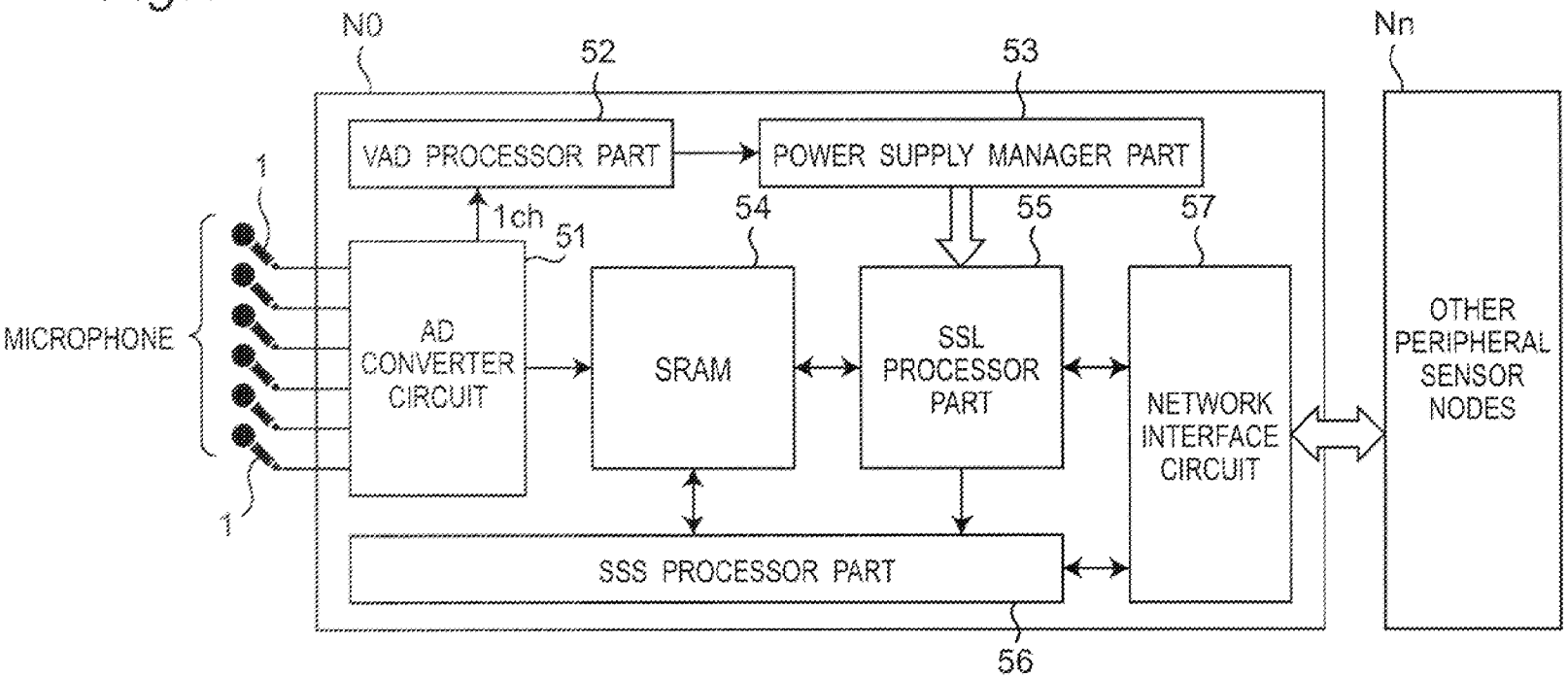
FIG. 1 is a block diagram showing a detailed configuration of a node device that is used in a speech source localization system according to a first preferred embodiment and in a position measurement system according to a second preferred embodiment of the present invention.

Preferred embodiments of the present invention will be described below with reference to the drawings. In the following preferred embodiments, like components are denoted by like reference numerals.

As described in the prior art, an independent distributed type routing algorithm is indispensable in a sensor network configured to include a number of node devices. A plurality of source origins of signals of the object of sensing exist in a sensing area, and routing using clustering is effective for configuring optimal paths for them. According to the preferred embodiments of the present invention, a sensor network system capable of efficiently performing data aggregation by using a speech source localization system in a sensor network system relevant to a microphone array network system intended for acquiring a speech of a high sound quality, and a communication method therefor are described below.

First Preferred Embodiment

FIG. 1 is a block diagram showing a detailed configuration of a node device that is used in a speech source localization system according to a first preferred embodiment and also used in a position measurement system according to a second preferred embodiment of the present invention. The speech source localization system of the present preferred embodiment is configured by using, for example, a ubiquitous network system (UNS), and the speech source localization system is configured to be a large-scale microphone array speech processing system as a whole by connecting small-scale microphone arrays (sensor node devices) each having, for example, 16 microphones on a predetermined network. In this case, a microphone processor is mounted on each of the sensor node devices, and speech processing is performed in a distributed and cooperative manner.

Referring to FIG. 1, each sensor node device is configured to include the following:

(1) an AD converter circuit 51 connected to a plurality of sound pickup microphones 1;

(2) a speech estimation processor part (for voice activity detection, hereinafter referred to as a VAD processor part, and VAD is referred to as speech activity detection hereinafter) 52 connected to the AD converter circuit 51 to detect a speech signal;

(3) an SRAM (Static Random Access Memory) 54, which temporarily stores a speech signal or a speech signal including a sound signal or the like (the sound signal means a signal at an audio frequency of, for example, 500 Hz or an ultrasonic signal) that has been subjected to AD-conversion by the AD converter circuit 51;

(4) an SSL processor part 55, which executes speech source localization processing to estimate the position of a speech source for the digital data of a speech signal or the like outputted from the SRAM 54, and outputs the results to the SSS processor part 56;

(5) an SSS processor part 56, which executes a speech source separation process to extract a specific speech source for the digital data of the speech signal or the like outputted from the SRAM 54 and the SSL processor part 55, and collects speech data of high SNR obtained as the results of the process by transceiving the data to and from other node devices via a network interface circuit 57; and (6) a network interface circuit 57, which configures a data communication part to transceive speech data, and is connected to other peripheral sensor node devices Nn (n=1, 2, . . . , N).

The sensor node devices Nn (n=0, 1, 2, . . . , N) have the same configuration as each other, and the sensor node device N0 of the base station can obtain speech data whose SNR is further improved by aggregating the speech data in the network. It is noted that the VAD processor part 52 and a power supply manager part 53 are used for the speech source localization of the first preferred embodiment, whereas they are not used as a principle in the position estimation of the second preferred embodiment. Moreover, distance estimation described later is executed in, for example, the SSL processor part 55.

In the system configured as above, input speech data from 16 microphones 1 is digitized by the AD converter circuit 51, and the information of the speech data is stored into the SRAM 54. Subsequently, the information is used for speech source localization and speech source separation. The speech processing including them is executed by the power supply manager part 53 that saves standby electricity and the VAD processor part 52. The speech processor part is turned off when no speech exists in the peripheries of the microphone array, and the power management is basically necessary because the numbers of microphones 1 waste much power when not in use.

Figure 2:
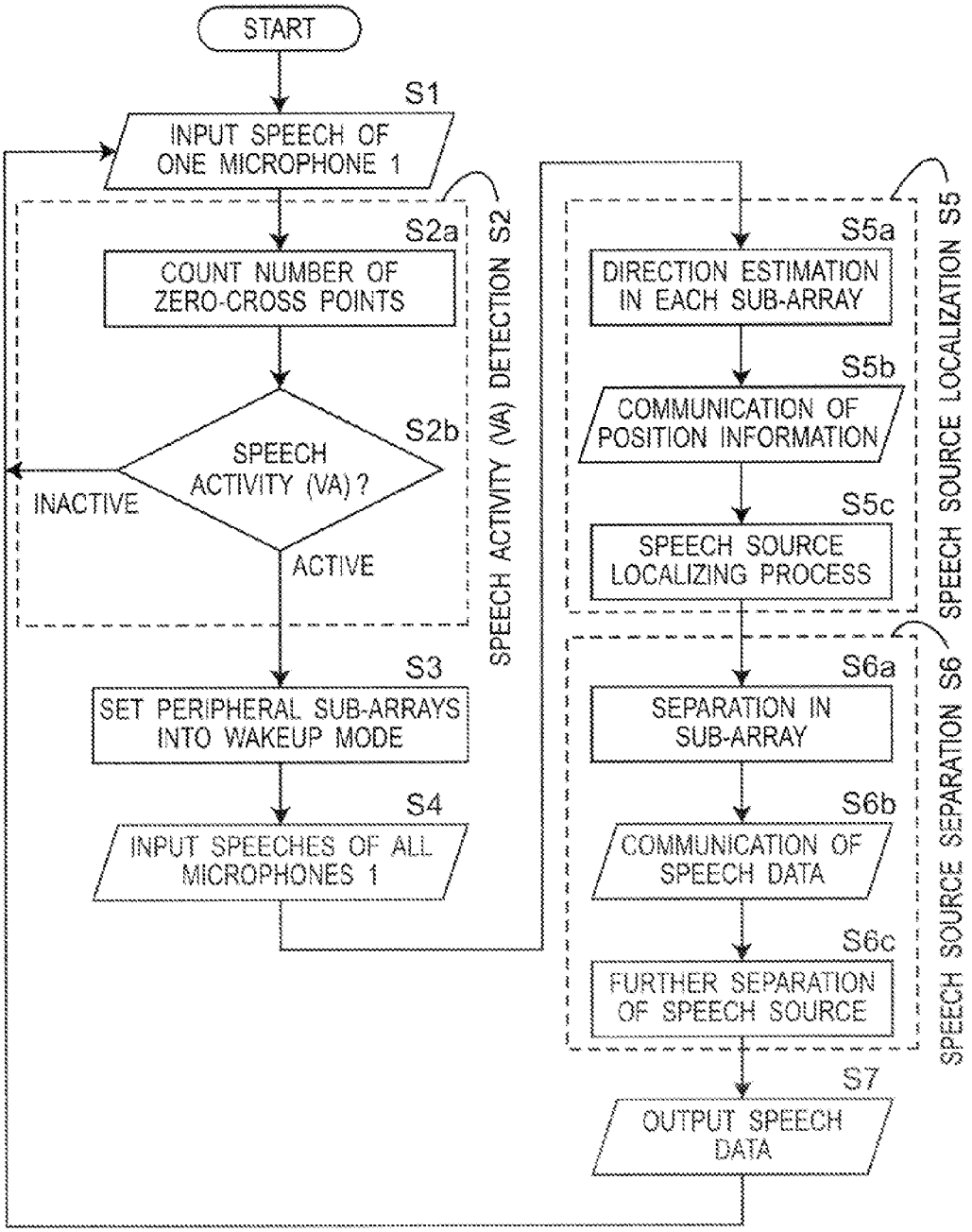
FIG. 2 is a flow chart showing processing in a microphone array network system used in the system of FIG. 1.

FIG. 2 is a flow chart showing processing in the microphone array network system used in the system of FIG. 1.

Referring to FIG. 2, a speech is inputted from one microphone 1 (S1), and a detection process (S2) of a speech activity (VA) is executed. In this case, the number of zero-cross points are counted (S2*a*), and it is judged whether or not the speech activity (speech estimation) has been detected (S2*b*). When the speech activity is detected, the peripheral sub-arrays are set into a wakeup mode (S3), and the speeches of all the microphones 1 are inputted (S4). Then, in a speech source localizing process (S5), after performing direction estimation in each sub-array (S5*a*), communication of position information (S5*b*) and a speech source localizing process (S5*c*), a speech source separation process (S6) is performed. In this case, separation in the sub-array (S6*a*), communication of speech data (S6*b*) and further separation of the speech source (S6*c*) are executed, and the speech data is outputted (S7).

The distinguished features of the present system are as follows.

(1) In order to activate the entire node device, low-power speech activity detection is performed.

(2) For the speech source localization, the speech source is localized (auditorily localized).

(3) In order to reduce the sound noise level, the speech source separation process is performed.

Moreover, the sub-array node devices are mutually connected to support intercommunications. Therefore, the speech data obtained at the node devices can be collected to further improve the SNR of the speech source. In the present system, a number of microphone arrays are configured via interactions with the peripheral node devices. Therefore, calculation can be distributed among the node devices. The present system has scalability (extendability) in the aspect of the number of microphones. Moreover, each of the node devices executes preparatory processing for the picked-up speech data.

Figure 3:
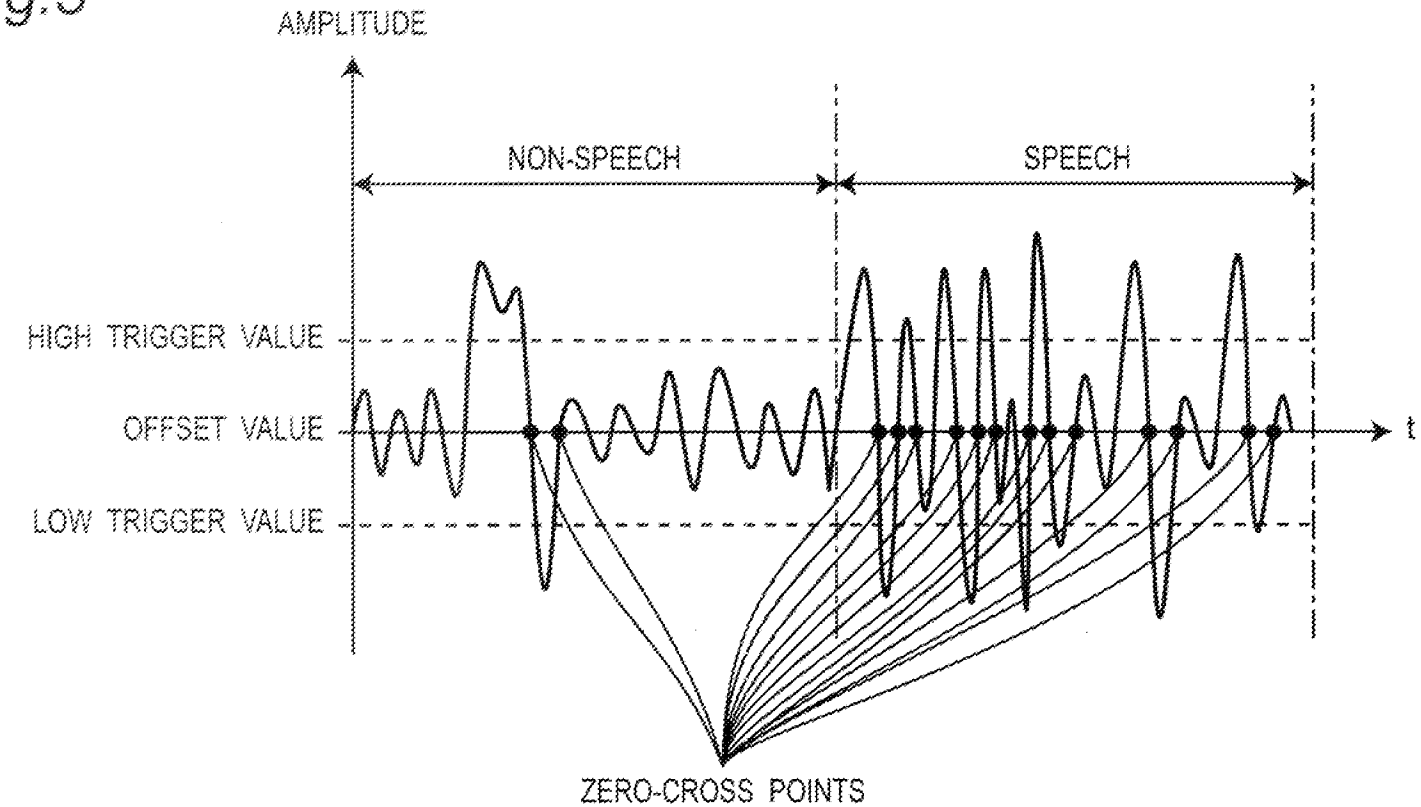
FIG. 3 is a waveform chart showing speech activity detection (VAD) at zero-cross points used in the system of FIG. 1.

FIG. 3 is a waveform chart showing a speech activity detection (VAD: voice activity detection) at the zero-cross points used in the system of FIG. 1.

The microphone array network of the present preferred embodiment is configured to include a number of microphones whose power consumption easily becomes tremendous. An intelligent microphone array system according to the present preferred embodiment is required to operate with a limited energy source in order to save power as far as possible. Since the speech processing unit and the microphone amplifier consume power to a certain extent even when the environment is quiet, speech processing with power saving is effective. Although the present inventor and others has proposed low power consumption VAD hardware implementation to reduce the standby electricity of the sub-arrays in a conventional apparatus, a zero-cross algorithm for VAD is used in the present preferred embodiment. As apparent from FIG. 3, the speech signal crosses a trigger line that is a high trigger value or a low trigger value, and thereafter, the zero-cross point is located at the first intersection of the input signal and an offset line. The abundance ratio of the zero-cross points remarkably differs between a speech signal and a non-speech signal. The zero-cross VAD detects the speech by detecting this difference and outputting the first point and the last point of the speech interval. The only requirement is to capture the crossing points throughout the range of the trigger line to the offset line. At this time, no detailed speech signal needs to be detected, and the sampling frequency and the bit count can be consequently reduced.

According to the VAD of the present inventor and others, the sampling frequency can be reduced to 2 kHz, and the bit count per sample can be set to 10 bits. A single microphone is sufficient for detecting a signal, and the remaining 15 microphones are also turned off likewise. These values are sufficient for detecting the human words, and in this case, the 0.18-μm CMOS process consumes only power of 3.49 μW.

By separating the low-power VAD processor part 52 from the speech processor part, the speech processor part (SSL processor part 55, SSS processor part 56, etc.) can be turned off by using the power supply manager part 53. Further, all the VAD processor parts 52 of all the node devices are required to operate. The VAD processor part 52 is activated merely by a limited number of node devices in the system. In the VAD processor part 52, a processor relevant to the main signal starts execution upon detecting a speech signal, and the sampling frequency and the bit count are increased to sufficient values. It is noted that the parameters to determine the analog factors in the specifications of the AD converter circuit 51 can be changed in accordance with the specific application integrated in the system.

Figure 4:
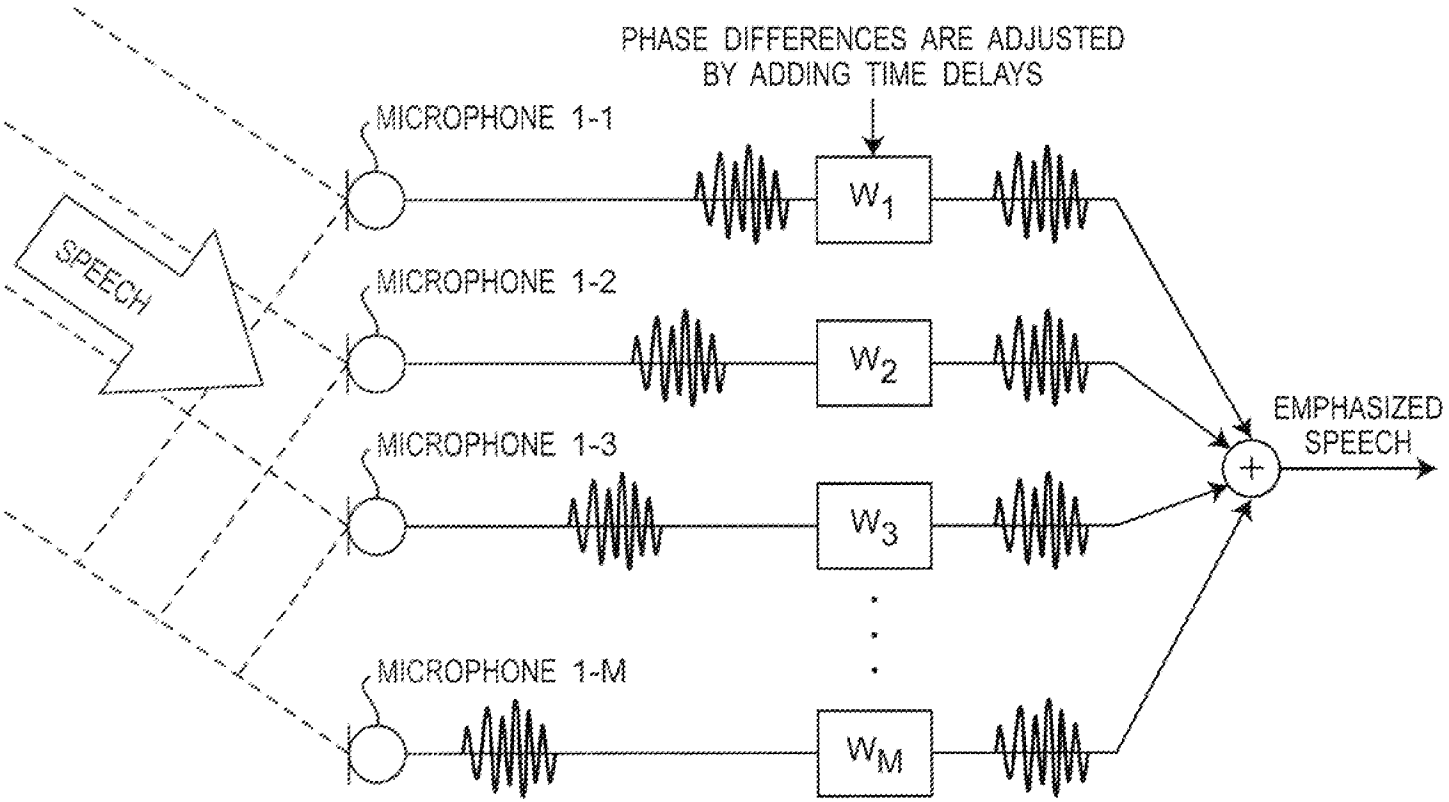
FIG. 4 is a block diagram showing a detail of a delay-sum circuit part used in the system of FIG. 1.

Next, a distributedly arranged speech capturing process is described below. FIG. 4 is a block diagram showing a detail of the delay-sum circuit part used in the system of FIG. 1. In order to acquire high-SNR speech data, the following two types of techniques have been proposed:

(1) a technique using geometrical position information; and (2) a statistical technique using no position information to improve the main speech source.

The system of the present preferred embodiment was premised on the fact that the node device positions in the network had been known, and therefore, a delay-sum beam to form an algorithm classified in the geometrical method (See, for example, the Non-Patent Document 6 and FIG. 4) was selected. This method obtains less distortion than the statistical method. Fortunately, it needs a small amount of calculations and is simply applicable to distributed processing. A key point to collect speech data from the distributed node devices is to juxtapose speech phases between adjacent node devices, and, in this case, a phase mismatch (=time delay) is generated by a difference in the distance from the speech source to each of the node devices.

Figure 5:
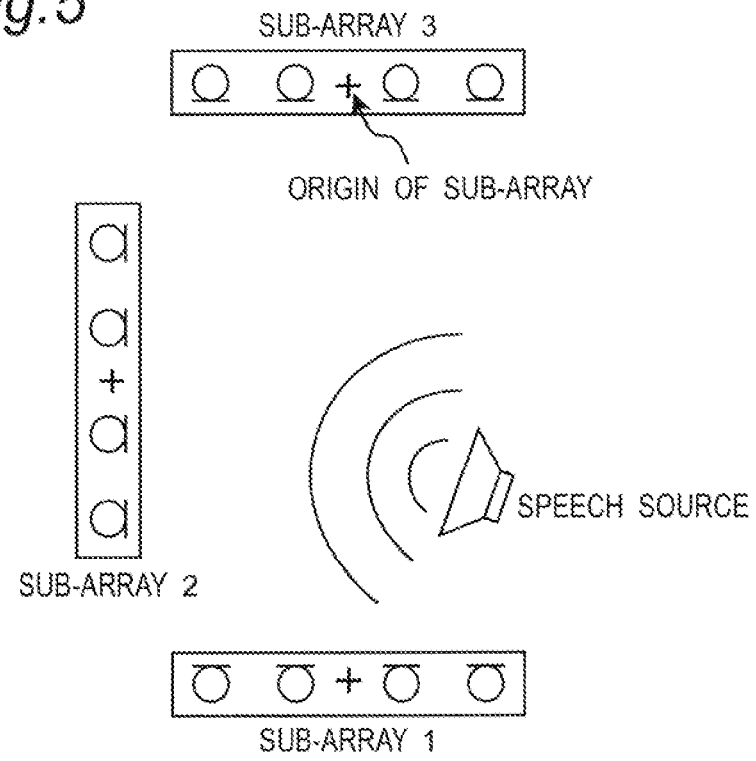
FIG. 5 is a plan view showing a basic principle of a plurality of distributedly arranged delay-sum circuit parts of FIG. 4.
Figure 6:
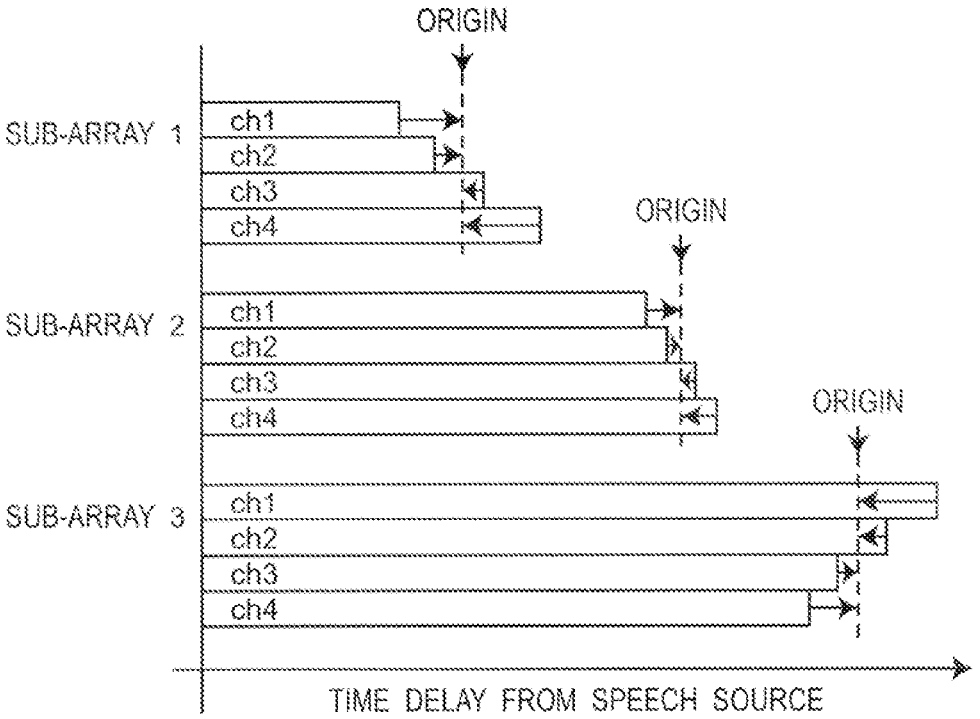
FIG. 6 is a graph showing a time delay from a speech source indicative of operation in the system of FIG. 5.

FIG. 5 is a plan view showing a basic principle of a plurality of the distributedly arranged delay-sum circuit parts of FIG. 4, and FIG. 6 is a graph showing a time delay from a speech source indicative of operation in the system of FIG. 5. In the present preferred embodiment, a two-layer algorithm is introduced to achieve a distributed delay-sum beam formed as shown in FIG. 5. In a local layer, each of the node devices collects speeches in 16 channels having local delays from the origin of the node device, and thereafter, the spread single sound is acquired into the node device by using the basic delay-sum algorithm. Subsequently, speech data emphasized with a definite global delay that can be calculated by the position of an addition array is transmitted to the adjacent node devices of a global layer and finally aggregated into speech data that has high SNR. A vocal packet includes a time stamp and the speech data of 64 samples. In this case, the time stamp is given as $T_{Packet}=T_{REC}-D_{sender}$. In this case, $T_{REC}$ represents a timer value in the sending side node device when the speech data in the packet is recorded, and $D_{Sender}$ represents a global delay at the origin of the sending side node device. In the receiving side node device, adjustment is performed by adding the global delay ($D_{Receiver}$) to $T_{Packet}$ in the received time stamp, and the speech data is aggregated in the delay-sum form (FIG. 6). Each of the node devices transmits the speech data in the single channel, whereas the high-SNR speech data can be consequently acquired in the base station.

Figure 7:
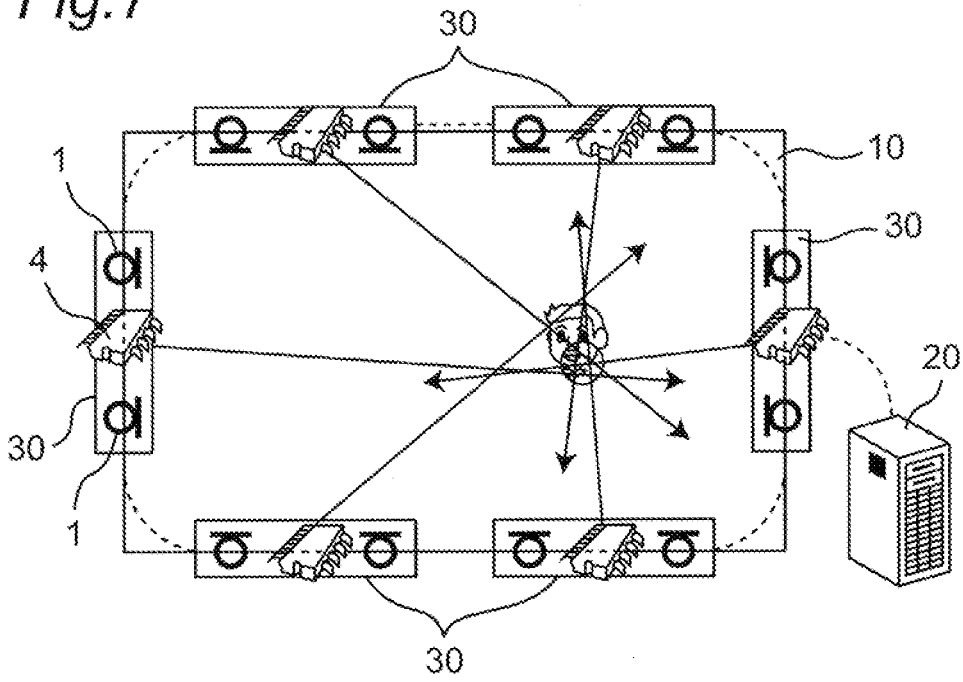
FIG. 7 is an explanatory view showing a configuration of a speech source localization system of the first preferred embodiment.

FIG. 7 shows an explanatory view of the speech source localization of the present invention. Referring to FIG. 7, six node devices having microphone arrays and one speech processing server 20 are connected together via a network 10. The six node devices having the microphone arrays configured by arranging a plurality of microphones in an array form exist on four indoor wall surfaces, the direction of the speech source is estimated by a processor for speech pickup processing existing in each of the node devices, and the position of the speech source is specified by integrating the results in the speech processing server. By virtue of data processing executed at each of the node devices, the communication traffic of the network can be reduced, and the calculation amount is distributed among node devices.

Figure 8:
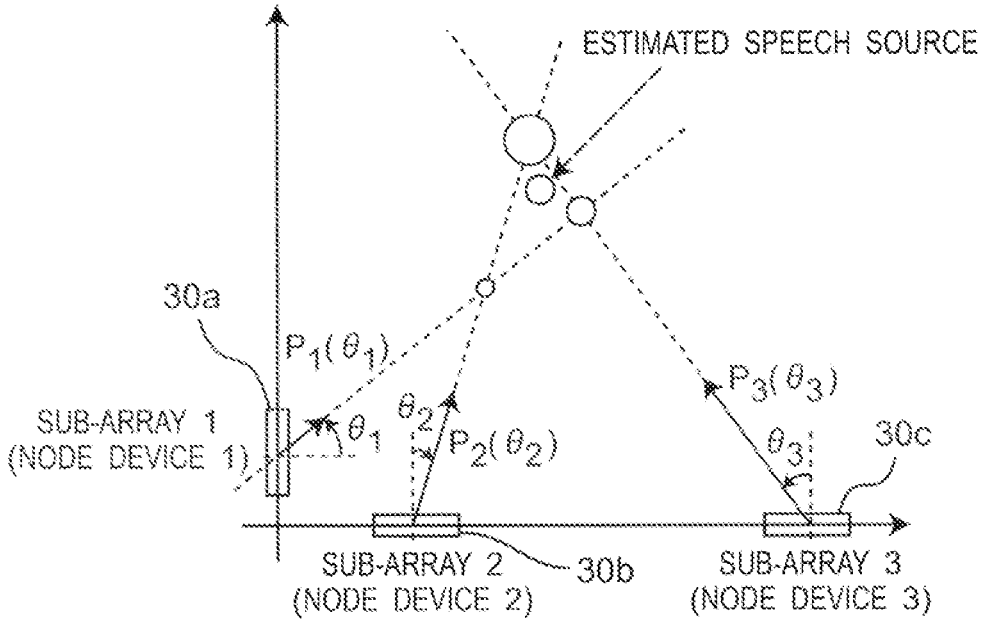
FIG. 8 is an explanatory view for explaining two-dimensional speech source localization in the speech source localization system of FIG. 7.

Detailed descriptions are provided below separately for a case of two-dimensional speech source localization and a case of three-dimensional speech source localization. First of all, the two-dimensional speech source localization method of the present invention is described with reference to FIG. 8. FIG. 8 describes the two-dimensional speech source localization method. Referring to FIG. 8, the node device 1 to the node device 3 estimate the directions of the speech source from pickup speech signals picked up from the respective microphone arrays. Each of the node devices calculates the response intensity of the MUSIC method in each direction, and estimates a direction in which the maximum value is taken to be the direction of the speech source. FIG. 8 shows a case where the node device 1 calculates the response intensity in the directions of −90 degrees to 90 degrees on an assumption that the perpendicular direction (frontward direction) of the array plane of the microphone array is 0 degree, and the direction of $\theta 1=-30$ degrees is estimated to be the direction of the speech source. The node device 2 and the node device 3 each also calculate likewise the response intensity in each direction, and estimate the direction in which the maximum value is taken to be the direction of the speech source.

Then, weighting is performed for the intersections of the speech source direction estimation results of two node devices between the node device 1 and the node device 2, between the node device 1 and the node device 3, and so on. In this case, the weight is determined on the basis of the maximum response intensity of the MUSIC method of each of the node devices (e.g., the product of the maximum response intensities of two node devices). In FIG. 8, the scale of the weight is expressed by the balloon diameter at each intersection.

The balloons (positions and scales) that represent a plurality of obtained weights become speech source position candidates. Then, the speech source position is estimated by obtaining the barycenter of the plurality of obtained speech source position candidates. In the case of FIG. 8, obtaining the barycenter of the plurality of speech source position candidates is to obtain the weighted barycenter of the balloons (positions and scales) that represent the plurality of weights.

Figure 9:
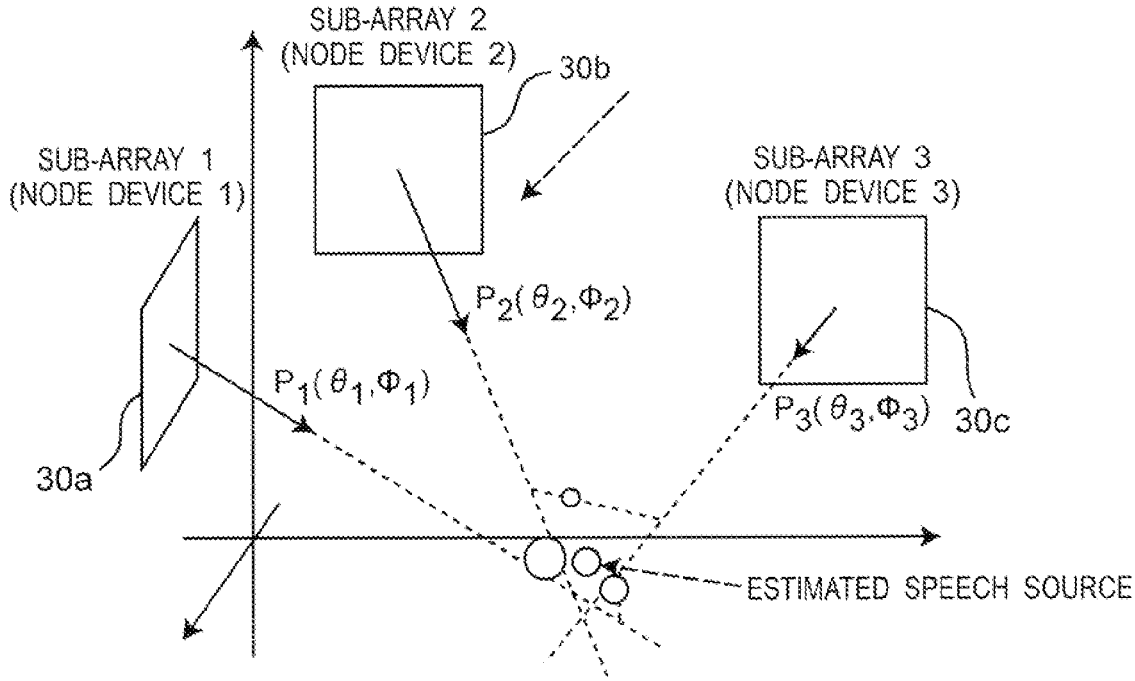
FIG. 9 is an explanatory view for explaining three-dimensional speech source localization in the speech source localization system of FIG. 7.

The three-dimensional speech source localization method of the present invention is described next with reference to FIG. 9. FIG. 9 describes the three-dimensional speech source localization method. Referring to FIG. 9, the node device 1 to the node device 3 estimate the directions of the speech source from the pickup speech signals picked up from the respective microphone arrays. Each of the node devices calculates the response intensity of the MUSIC method in the three-dimensional directions, and estimates the direction in which the maximum value is taken to be the direction of the speech source. FIG. 9 shows a case where the node device 1 calculates the response intensity in the rotation coordinate system in the perpendicular direction (frontward direction) of the array plane of the microphone array, and estimates the direction of the greater intensity is estimated to be the direction of the speech source. The node device 2 and the node device 3 each also calculate likewise the response intensity in each direction, and estimate the direction in which the maximum value is taken to be the direction of the speech source.

Then, weighting is performed for the intersections of speech source direction estimation results of two node devices between the node device 1 and the node device 2, between the node device 1 and the node device 3, and so on. However, it is often the case where no intersection can be obtained in the three-dimensional case. Therefore, the intersection is obtained virtually on a line segment that connects the straight lines of the speech source direction estimation results of two node devices at the shortest distance. It is noted that the weight is determined on the basis of the maximum response intensity of the MUSIC method at each of the node devices (e.g., the product of the maximum response intensities of two node devices) in a manner similar that of the two-dimensional case. In FIG. 9, the scale of the weight is expressed by the balloon diameter at each intersection in a manner similar that of FIG. 8.

The balloons (positions and scales) that represent a plurality of obtained weights become speech source position candidates. Then, the speech source position is estimated by obtaining the barycenter of the plurality of obtained speech source position candidates. In the case of FIG. 9, obtaining the barycenter of the plurality of speech source position candidates is to obtain the weighted barycenter of the balloons (positions and scales) that represent the plurality of weights.

FIRST IMPLEMENTAL EXAMPLE

Figure 10:
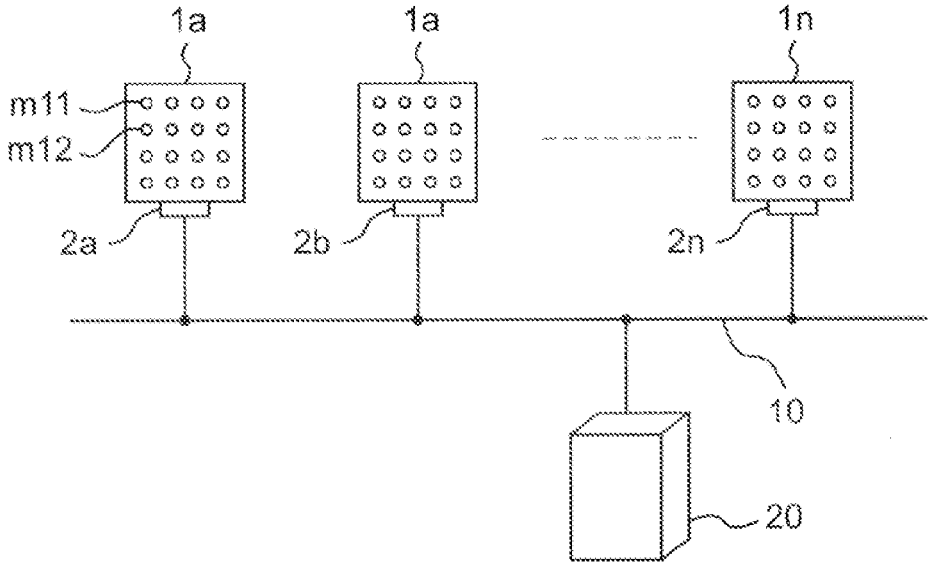
FIG. 10 is a schematic view showing a configuration of a microphone array network system according to a first implemental example of the present invention.
Figure 11:
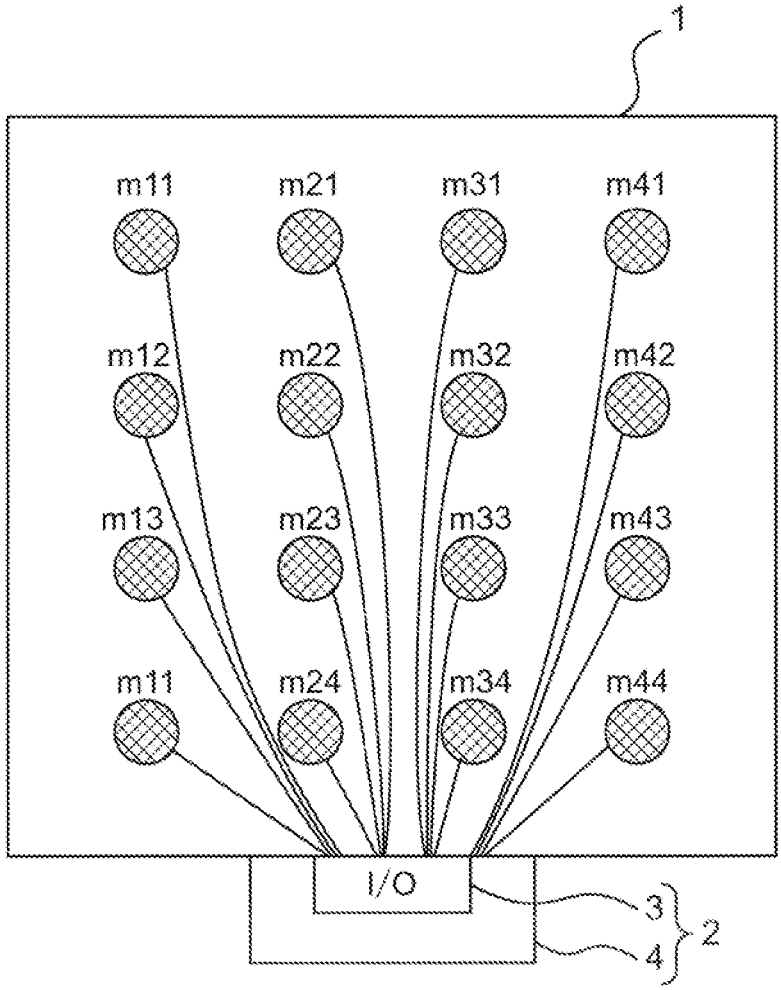
FIG. 11 is a schematic view showing a configuration of a node device having the microphone array of FIG. 10.

One implemental example of the present invention is described. FIG. 10 is a schematic view of a microphone array network system of the first implemental example. FIG. 10 shows the system configuration in which node devices (1*a*, 1*b*, . . . , 1*n*) each having a microphone array of 16 microphones arranged in an array form and one speech processing server 20 are connected together via a network 10. In each of the node devices, as shown in FIG. 11, signal lines of the 16 microphones (m11, m12, . . . , m43, m44) arranged in an array form are connected to the input and output part (I/O part) 3 of the speech pickup processor part 2, and signals picked up from the microphones are inputted to the processor 4 of the speech pickup processor part 2. The processor 4 of the speech pickup processor part 2 estimates the direction of the speech source by executing processing of the algorithm of the MUSIC method using the inputted speech pickup signal.

Then, the processor 4 of the speech pickup processor part 2 transmits the speech source direction estimation results and the maximum response intensity to the speech processing server 20 shown in FIG. 7.

As described above, speech localization is distributedly performed in each of the node devices, the results are integrated in the speech processing server, and the aforementioned two-dimensional localization and the three-dimensional localization processing are performed to estimate the position of the speech source.

Figure 12:
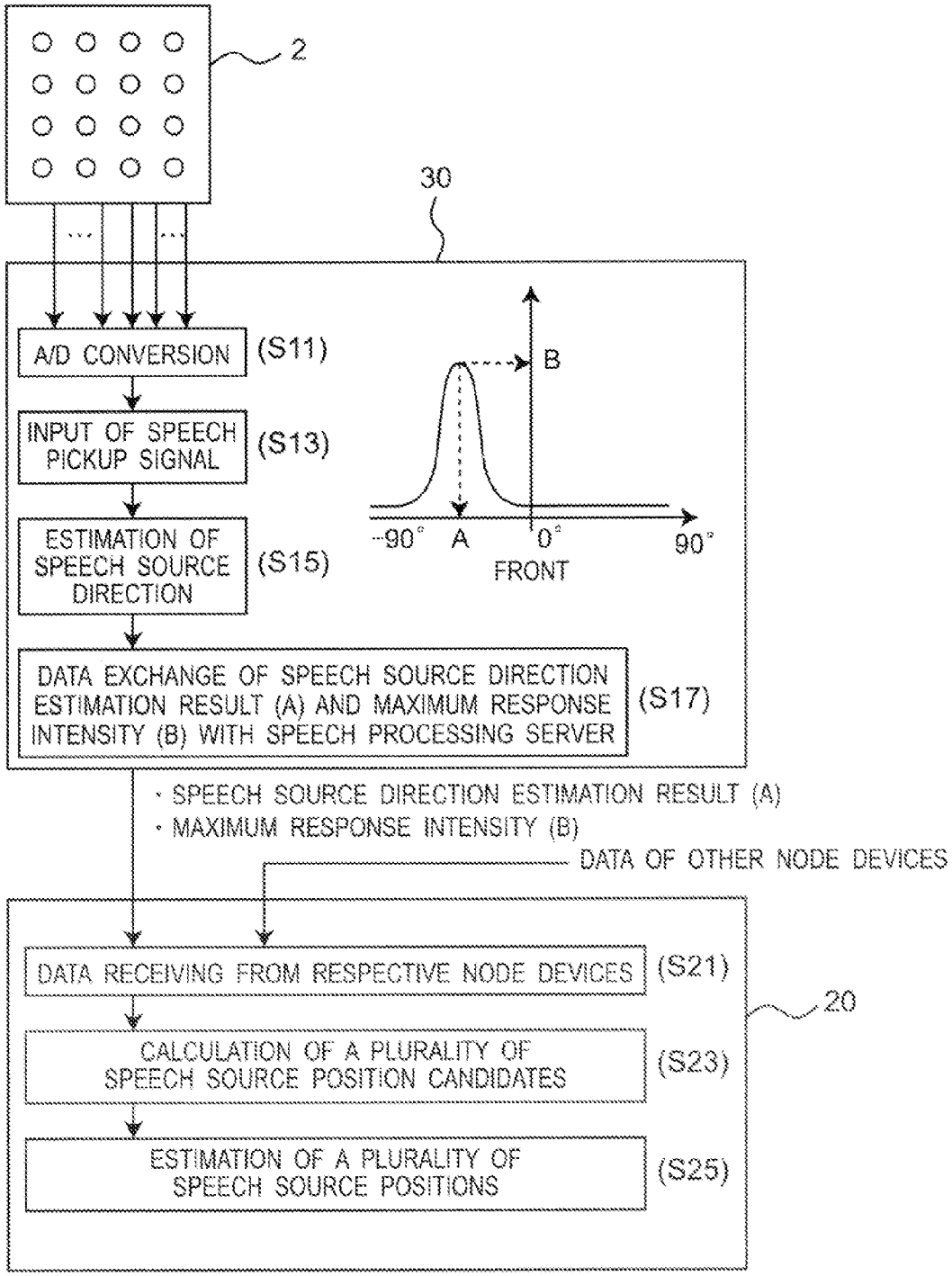
FIG. 12 is a functional diagram showing functions of the microphone array network system of FIG. 7.

FIG. 12 is a functional diagram showing functions of the microphone array network system of the first implemental example.

The node device having the microphone array subjects the signal from the microphone array to A/D conversion (step S11), and receives the speech pickup signal of each microphone as an input (step S13). By using the speech signals picked up from the microphones, the direction of the speech source is estimated by the processor mounted on the node device operating as the speech pickup processor part (step S15).

As shown in the graph of FIG. 12, the speech pickup processor part calculates the response intensity of the MUSIC method within the directional angles of −90 degrees to 90 degrees with respect to 0 degree assumed to be the front (perpendicular direction) of the microphone array. Then, the direction in which the response intensity is intense is estimated to be the direction of the speech source. The speech pickup processor part is connected to the speech processing server via a network not shown in the figure, and the speech source direction estimation result (A) and the maximum response intensity (B) are data exchanged in the node device (step S17). The speech source direction estimation result (A) and the maximum response intensity (B) are sent to the speech processing server.

In the speech processing server, the data sent from respective node devices are received (step S21). A plurality of speech source position candidates are calculated from the maximum response intensity of each of the node devices (step S23). Then, the position of the speech source is estimated on the basis of the speech source direction estimation result (A) and the maximum response intensity (B) (step S25).

Figure 13:
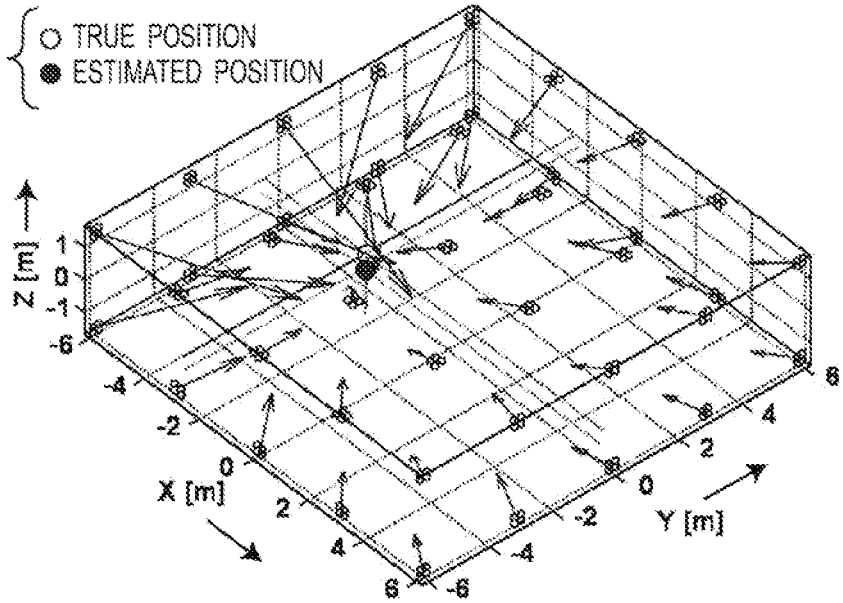
FIG. 13 is an explanatory view for explaining experiments of three-dimensional speech source localization accuracy in the microphone array network system of FIG. 7.

The three-dimensional speech source localization accuracy is described below. FIG. 13 schematically shows the condition of an experiment of three-dimensional speech source localization accuracy. A room having a floor area of 12 meters×12 meters and a height of 3 meters is assumed. Sixteen sub-arrays configured by placing 16 microphone arrays of microphones arranged in an array form at equal intervals in four directions on the floor surface were assumed (Case A of 16 sub-arrays). Moreover, 41 sub-arrays configured by placing 16 microphone arrays at equal intervals in four directions on the floor surface, placing 16 microphone arrays at equal intervals in four directions on the ceiling surface, and placing nine microphone arrays at equal intervals on the floor surface were assumed (Case B of 41 sub-arrays). Moreover, 73 sub-arrays configured by placing 32 microphone arrays at equal intervals in four directions on the floor surface, placing 32 microphone arrays at equal intervals in four directions on the ceiling surface, and placing nine microphone arrays at equal intervals on the floor surface were assumed (Case C of 73 sub-arrays).

By using the three Cases A to C, the number of node devices and the dispersion of speech source direction estimation errors of the node devices were changed, and the results of three-dimensional position estimation were compared to one another. Regarding the three-dimensional position estimation, each of the node devices selects one other party of communication at random, and obtains a virtual intersection.

Figure 14:
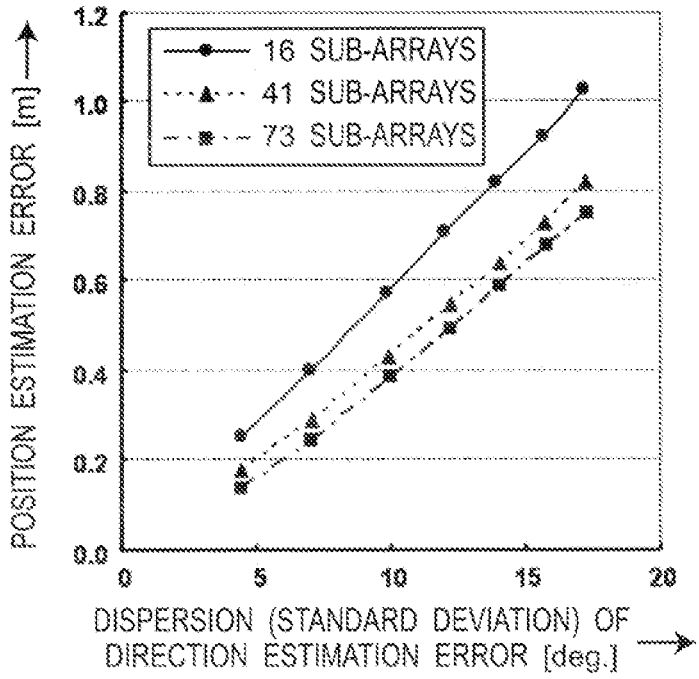
FIG. 14 is a graph showing measurement results indicating improvements in the three-dimensional speech source localization accuracy in the microphone array network system of FIG. 7.
Figure 15:
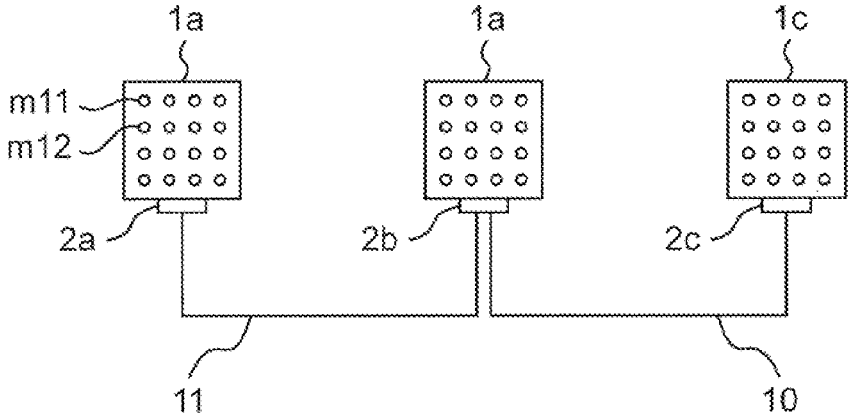
FIG. 15 is a schematic view showing a configuration of a microphone array network system according to a second implemental example of the present invention.

The results of the measurement are shown in FIG. 14. The horizontal axis of FIG. 14 represents the dispersion (standard deviation) of the direction estimation error, and the vertical axis represents the position estimation error. It can be understood from the results of FIG. 14 that the accuracy of three-dimensional position estimation can be improved by increasing the number of node devices even if the estimation accuracy of the speech source direction is bad.

SECOND IMPLEMENTAL EXAMPLE

Figure 16:
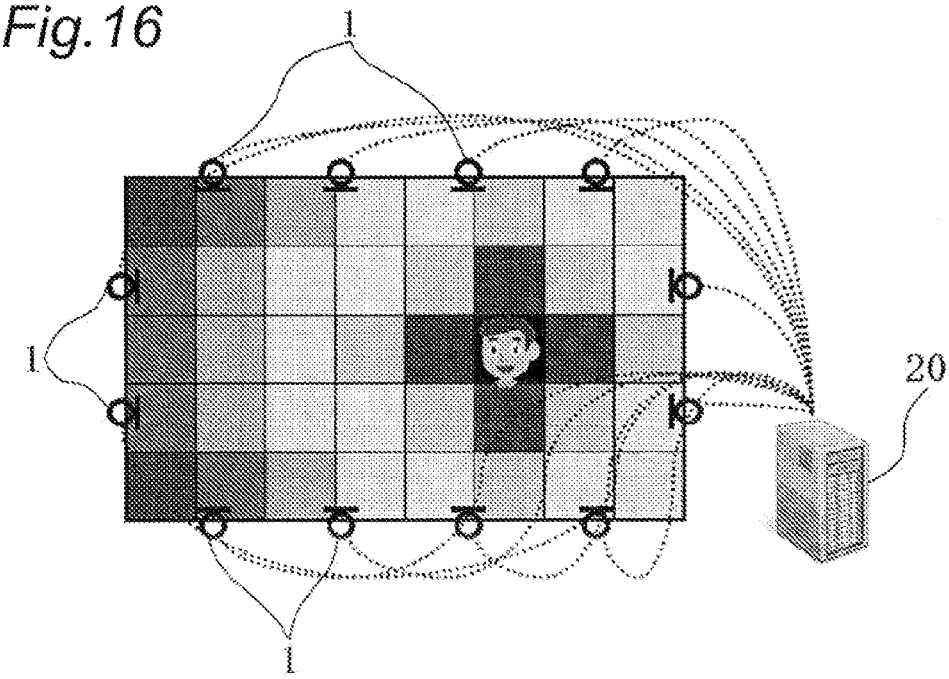
FIG. 16 is an explanatory view for explaining the speech source localization system of the second implemental example of FIG. 15.
Figure 17:
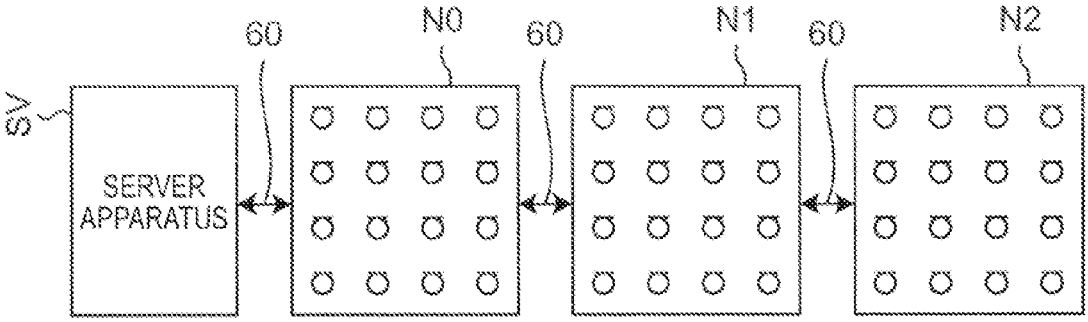
FIG. 17 is a block diagram showing a configuration of a network used in the position measurement system of the second preferred embodiment of the present invention.

Another implemental example of the present invention is described. FIG. 16 shows a schematic view of a microphone array network system according to a second implemental example. FIG. 17 shows a system configuration such that node devices (1*a*, 1*b*, 1*c*) each having a microphone array in which 16 microphones are arranged in an array form are connected via networks (11, 12). In the case of the system of second implemental example, no speech processing server exists that is different from the system configuration of the first implemental example. Moreover, as shown in FIG. 11 in a manner similar to that of the first implemental example, signal lines of arrayed 16 microphones (m11, m12, . . . , m43, m44) are connected to the I/O part 3 of the speech pickup processor part 2 at each of the node devices, and signals picked up from the microphones are inputted to the processor 4 of the speech pickup processor part 2. The processor 4 of the speech pickup processor part 2 estimates the direction of the speech source by executing processing of the algorithm of the MUSIC method.

Then, the processor 4 of the speech pickup processor part 2 exchanges data of speech source direction estimation results between the processor and adjacent node devices and other node devices. The processor 4 of the speech pickup processor part 2 executes processing of the aforementioned two-dimensional localization or three-dimensional localization from the speech source direction estimation results and the maximum response intensities of the plurality of node devices including the self-node device, and estimates the position of the speech source.

Second Preferred Embodiment

FIG. 1 is a block diagram showing a detailed configuration of a node device used in a position measurement system according to the second preferred embodiment of the present invention. The position measurement system of the second preferred embodiment is characterized in measuring the position of a terminal more accurately than that in the prior art by using the speech source localization system of the first preferred embodiment. The position measurement system of the present preferred embodiment is configured by employing, for example, a ubiquitous network system (UNS). By connecting small-scale microphone arrays (sensor node devices) each having, for example, 16 microphones via a predetermined network, a large-scale microphone array speech processing system is configured as a whole, thereby configuring a position measurement system. In this case, microphone processors are mounted on the respective sensor node devices, and speech processing is performed distributedly and cooperatively.

The sensor node device has the configuration of FIG. 1, and, one example of the processing at each sensor node device is described hereinbelow. First of all, all the sensor node devices are in the sleep state in the initial stage. At several sensor node devices located apart to a certain extent, for example, one sensor node device transmits a sound signal for a predetermined time interval such as three seconds, and a sensor node device that detects the sound signal starts speech source direction estimation by multi-channel inputs. At the same time, a wakeup message is broadcasted to other sensor node devices existing in the peripheries, and the sensor node devices that have received the message also immediately start speech source direction estimation. After completing the speech source direction estimation, each sensor node device transmits an estimated result to the base station (sensor node device connected to the server apparatus). The base station estimates the speech source position by using the collected direction estimation results of the sensor node devices, and broadcasts the results toward all the sensor node devices that have performed the speech source direction estimation. Next, each sensor node device performs speech source separation by using the position estimation results received from the base station. In a manner similar that of the speech source localization, speech source separation is executed separately in two steps internally at each sensor node device and among sensor node devices. The speech data obtained at the sensor node devices are aggregated again in the base station via the network. The finally obtained high-SNR speech signal is transmitted from the base station to the server apparatus, and used for a predetermined application on the server apparatus.

Figure 18A:
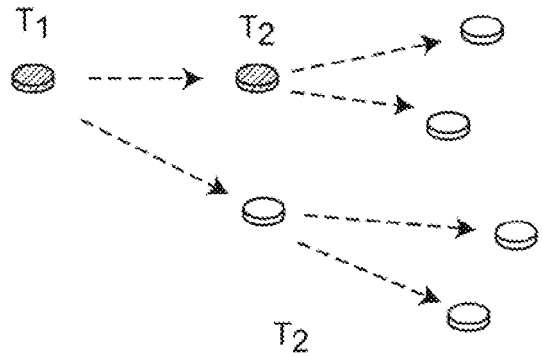
FIG. 18A is a perspective view showing a method of flooding time synchronization protocol (FTSP) used in the position measurement system of FIG. 17.
Figure 18B:
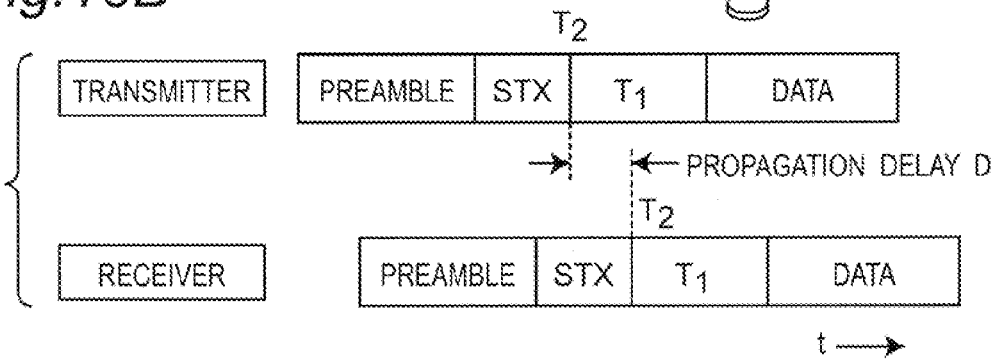
FIG. 18B is a timing chart showing a condition of data propagation indicative of the method.
Figure 19:
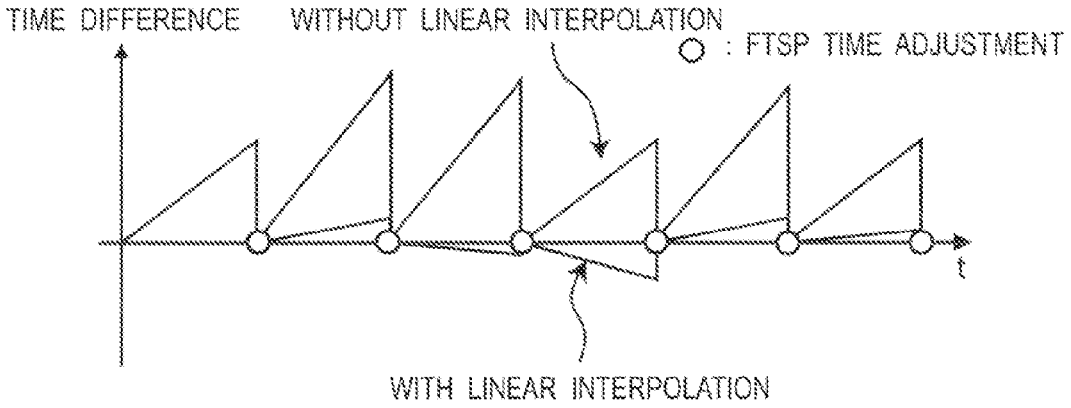
FIG. 19 is a graph showing time synchronization with linear interpolation used in the position measurement system of FIG. 17.

FIG. 17 is a block diagram showing a configuration (concrete example) of a network used in the position measurement system of the present preferred embodiment. FIG. 18A is a perspective view showing a method of flooding time synchronization protocol (FTSP) used in the position measurement system of FIG. 17, and FIG. 18B is a timing chart showing a condition of data propagation indicative of the method. In addition, FIG. 19 is a graph showing time synchronization with linear interpolation used in the position measurement system of FIG. 17.

Referring to FIG. 17, sensor node devices N0 to N2 including the server apparatus SV are connected by way of, for example, UTP cables 60, and communications are performed by using 10BASE-T Ethernet (registered trademark). In the present implemental example, the sensor node devices N0 to N2 are connected with each other in a linear topology, where one sensor node device N0 operates as a base station and is connected to a server apparatus SV configured to include, for example, a personal computer. The known low power listening method is used for power consumption saving in the data-link layer of the communication system, and the known tiny diffusion method is used for the path formulation in the network layer.

In order to aggregate speech data among the sensor node devices N0 to N2 in the present preferred embodiment, it is required to synchronize time (timer value) at all the sensor node devices in the network. In the present preferred embodiment, a synchronization technique configured by adding linear interpolation to the known flooding time synchronization protocol (FTSP) is used. The FTSP is to achieve high-accuracy synchronization only by simple communications in one direction. Although the synchronization accuracy by the FTSP is equal to or smaller than one microsecond between adjacent sensor node devices, there are variations in the quartz oscillators owned by the sensor node devices, and a time deviation disadvantageously occurs with a lapse of time after the synchronization process as shown in FIG. 19. The deviation ranges from several microseconds to several tens of microseconds per second, and it is concerned that the performance of speech source separation might be degraded.

FIG. 18A is a perspective view showing a method of flooding time synchronization protocol (FTSP) (See, for example, the Non-Patent Document 8) used in the position measurement system of FIG. 17, and FIG. 18B is a timing chart showing a condition of data propagation indicative of the method.

In the proposed system of the present preferred embodiment, a time deviation between sensor node devices is stored at the time of time synchronization by the FTSP, and the time progress of the timer is adjusted by linear interpolation. Assuming that a reception time stamp at the first synchronization time is the timer value on the receiving side, by adjusting the time progress of the timer only in the period of a time stamp at the second synchronization time, the dispersion of the oscillation frequency can be corrected. With this arrangement, a time deviation after completing the synchronization can be suppressed within 0.17 microseconds per second. Even if the time synchronization by the FTSP occurs once in one minute, the time deviation between sensor node devices is suppressed within 10 microseconds by performing linear interpolation, and the performance of the speech source separation can be maintained.

By storing a relative time (e.g., the elapsed time is defined as a relative time on an assumption that the time when the first sensor node device is turned on is zero) or the absolute time (e.g., the day, hour, minute and second on a calendar is set as the time), the time synchronization is performed among the sensor node devices by the aforementioned method. The time synchronization is used for measuring the accurate distance between sensor node devices as described later.

Figure 20A:
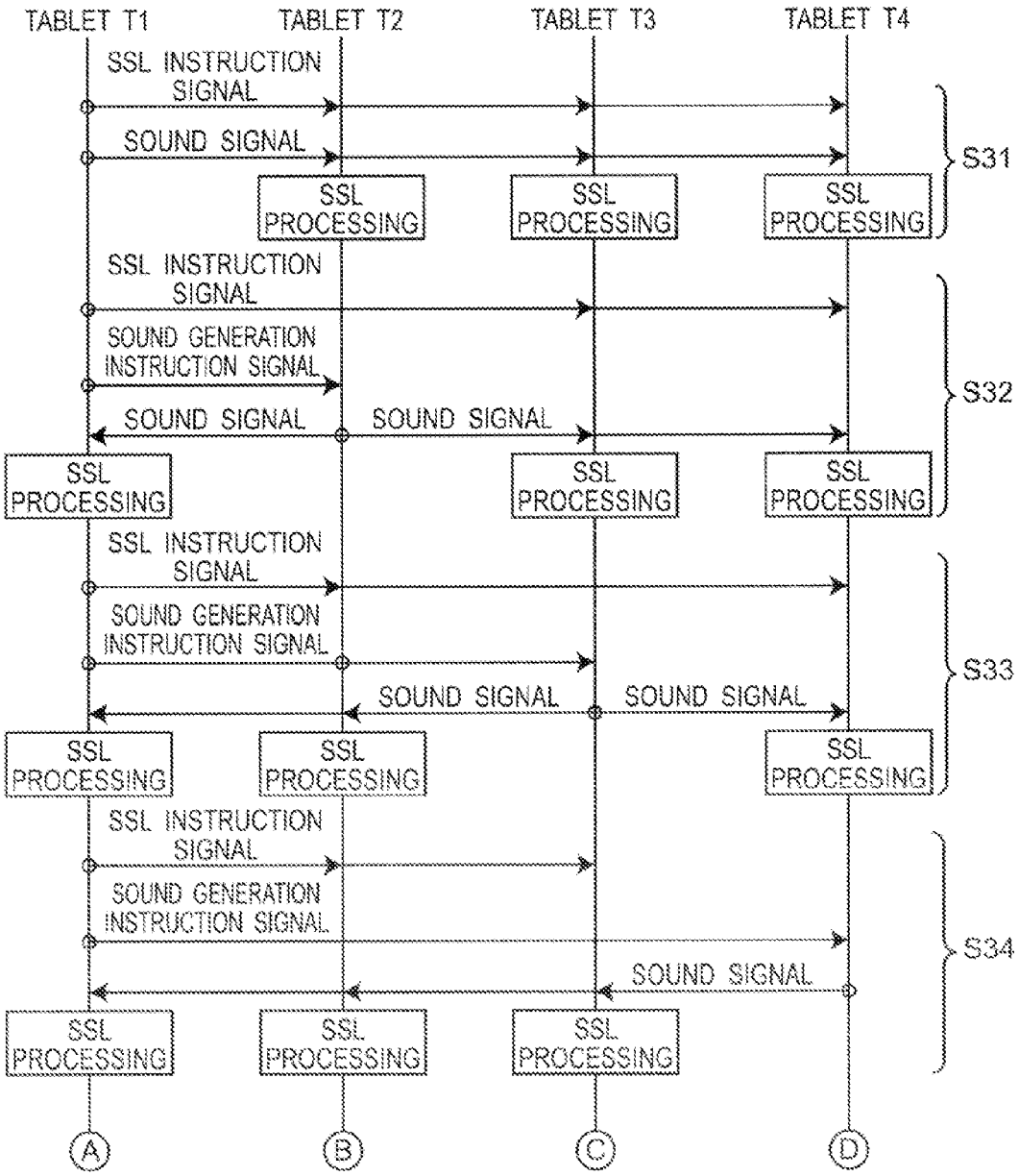
FIG. 20A is a first part of a timing chart showing a signal transmission procedure between tablets, and processes executed at the tablets in the position measurement system of FIG. 17.
Figure 20B:
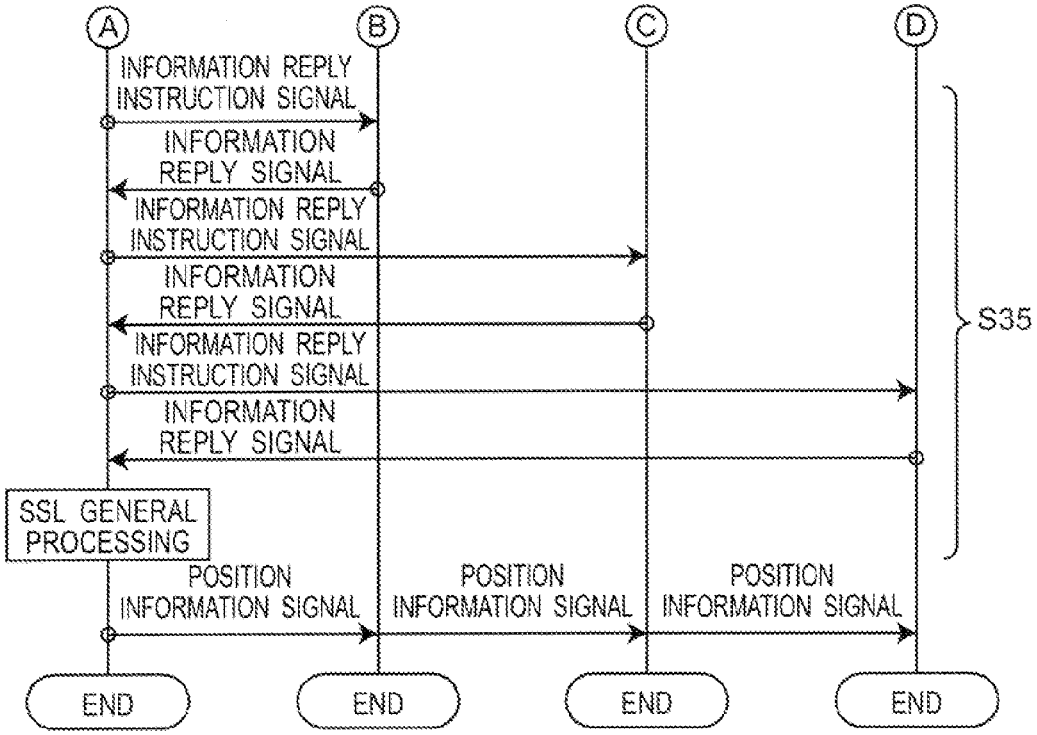
FIG. 20B is a second part of the timing chart showing a signal transmission procedure between the tablets, and the processes executed at the tablets in the position measurement system of FIG. 17.

FIGS. 20A and 20B are timing charts showing a signal transmission procedure among tablets T1 to T4 and processes executed at the tablets T1 to T4 in the position measurement system of the second preferred embodiment. In this case, the tablets T1 to T4 having, for example, the configuration of FIG. 1 is configured to include the aforementioned sensor node devices. The following description describes a case where the tablet T1 is assumed to be a master, and the tablets T2 to T4 are assumed to be slaves. However, it is acceptable to arbitrarily set the number of tablets and use any tablet as the master. Moreover, the sound signal may be audible sound waves, ultrasonic waves exceeding the frequencies in the audible range or the like. In this case, regarding the sound signal, for example, the AD converter circuit 51 may additionally include a DA converter circuit and generates an omni-directional sound signal from one microphone 1 in response to the instruction of the SSL processor part 55 or may include an ultrasonic generator device and generate an ultrasonic omni-directional sound signal in response to the instruction of the SSL processor part 55. Further, the SSS processing need not be executed in FIGS. 20A and 20B.

Referring to FIG. 20A, first in step S31, the tablet T1 transmits an "SSL instruction signal of an instruction to prepare for receiving the sound signal with the microphone 1 and execute the SSL processing in response to the sound signal" to the tablets T2 to T4, and thereafter, transmits a sound signal for a predetermined time of, for example, three seconds after a lapse of a predetermined time. The SSL instruction signal contains the transmission time information of the sound signal. The tablets T2 to T4 calculate a distance between the tablet T1 and the self-tablet by calculating a difference between the time when the sound signal is received and the aforementioned transmission time information, i.e., the transmission time of the sound signal and multiplying the known velocity of sound waves or ultrasonic waves by the calculated transmission time, and stores the calculated results into a built-in memory. Moreover, the tablets T2 to T4 estimate and calculate the arrival direction of the sound signal by executing the speech source localizing process on the basis of the received sound signal using the MUSIC method (See, for example, the Non-Patent Document 7) described in detail in the first preferred embodiment, and stores the calculated results into the built-in memory. That is, the distance from the tablet T1 to the self-tablet, and an angle to the tablet T1 are estimated, calculated and stored by the SSL processing of the tablets T2 to T4.

Subsequently, in step S32, the tablet T1 transmits an "SSL instruction signal of an instruction to prepare for receiving with the microphone 1 and execute the SSL processing in response to the sound signal" to the tablets T3 and T4, and thereafter, transmits a sound generation instruction signal to generate a sound signal to the tablet T2 after a lapse of a predetermined time. In this case, the tablet T1 is also brought into a standby state of the sound signal. The tablet T2 generates a sound signal in response to the sound generation instruction signal, and transmits the signal to the tablets T1, T3 and T4. The tablets T1, T3 and T4 estimate and calculate the arrival direction of the sound signal by executing the speech source localizing process on the basis of the received sound signal using the MUSIC method described in detail in the first preferred embodiment, and store the calculated results into the built-in memory. That is, an angle to the tablet T2 is estimated, calculated and stored by the SSL processing of the tablets T1, T3 and T4.

Further, in step S33, the tablet T1 transmits an "SSL instruction signal of an instruction to prepare for receiving with the microphone 1 and execute the SSL processing in response to the sound signal" to the tablets T2 and T4, and thereafter, transmits a sound generation instruction signal to generate a sound signal to the tablet T3 after a lapse of a predetermined time. In this case, the tablet T1 is also brought into the standby state of the sound signal. The tablet T3 generates a sound signal in response to the sound generation instruction signal, and transmits the signal to the tablets T1, T2 and T4. The tablets T1, T2 and T4 estimate and calculate the arrival direction of the sound signal by executing the speech source localizing process on the basis of the received sound signal using the MUSIC method described in detail in the first preferred embodiment, and store the calculated results into the built-in memory. That is, an angle to the tablet T3 is estimated, calculated and stored by the SSL processing of the tablets T1, T3 and T4.

Furthermore, in step S34, the tablet T1 transmits an "SSL instruction signal of an instruction to prepare for receiving with the microphone 1 and execute the SSL processing in response to the sound signal" to the tablets T2 and T3, and thereafter, transmits a sound generation instruction signal to generate a sound signal to the tablet T4 after a lapse of a predetermined time. In this case, the tablet T1 is also brought into the standby state of the sound signal. The tablet T4 generates a sound signal in response to the sound generation instruction signal, and transmits the signal to the tablets T1, T2 and T3. The tablets T1, T2 and T3 estimate and calculate the arrival direction of the sound signal by executing the speech source localizing process on the basis of the received sound signal using the MUSIC method described in detail in the first preferred embodiment, and store the calculated results into the built-in memory. That is, an angle to the tablet T4 is estimated, calculated and stored by the SSL processing of the tablets T1, T2 and T3.

Subsequently, in step S35 to perform data communications, the tablet T1 transmits an information reply instruction signal to the tablet T2. In response to this, the tablet T2 sends an information reply signal that includes the distance between the tablets T1 and T2 calculated in step S31 and the angles when the tablets T1, T3 and T4 are viewed from the tablet T2 calculated in steps S31 to S34 back to the tablet T1. Moreover, the tablet T1 transmits an information reply instruction signal to the tablet T3. In response to this, the tablet T3 sends an information reply signal that includes the distance between the tablets T1 and T3 calculated in step S31 and the angles when the tablets T1, T2 and T4 are viewed from the tablet T3 calculated in steps S31 to S34 back to the tablet T1. Further, the tablet T1 transmits an information reply instruction signal to the tablet T4. In response to this, the tablet T4 sends an information reply signal that includes the distance between the tablets T1 and T4 calculated in step S31 and the angles when the tablets T1, T2 and T3 are viewed from the tablet T4 calculated in steps S31 to S34 back to the tablet T1.

In the SSL general processing of the tablet T1, the tablet T1 calculates the distances between the tablets on the basis of the information collected as described above as follows as described with reference to FIG. 21, and calculates the XY coordinates of the other tablets T2 to T4 when, for example, the tablet T1 (A of FIG. 21) is assumed to be the origin of the XY coordinates on the basis of the angle information when each of the tablets T1 to T4 view the other tablets by using the definitional equation of the known trigonometric function, thereby allowing the XY coordinates of all the tablets T1 to T4 to be obtained. The coordinate values may be displayed on a display or outputted to a printer to be printed out. Moreover, it is acceptable to execute, for example, a predetermined application described in detail later by using the aforementioned coordinate values.

The SSL general processing of the tablet T1 may be performed by only the tablet T1 that is the master or performed by all the tablets T1 to T4. That is, at least one tablet or server apparatus (e.g., SV of FIG. 17) is required to execute the processing. Moreover, the SSL processing and the SSL general processing are executed by, for example, the SSL processor part 55 that is the control part.

Figure 21:
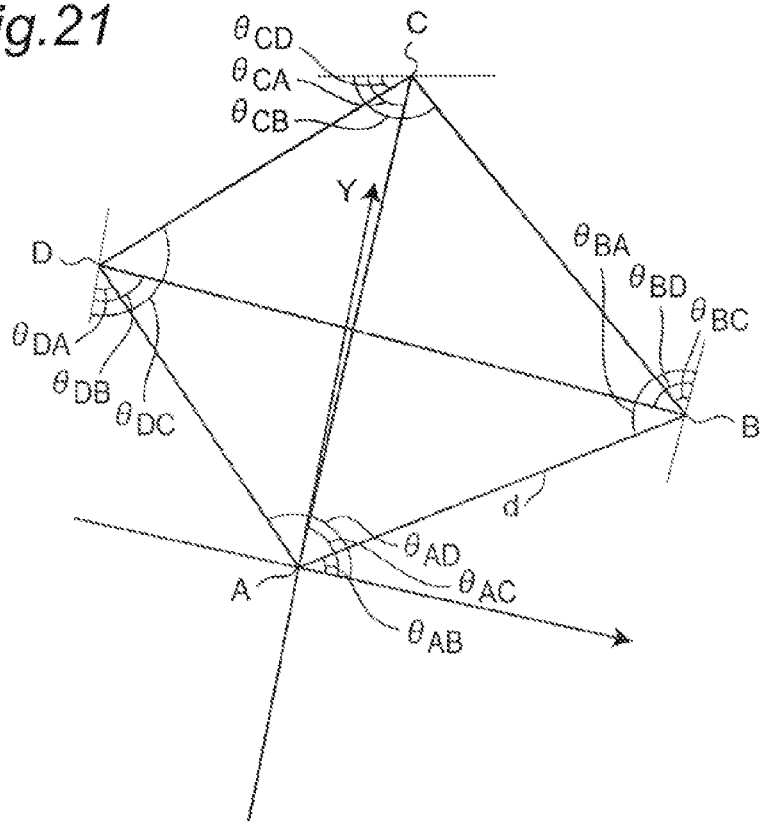
FIG. 21 is a plan view showing a method for measuring distances between the tablets from angle information measured at the tablets of the position measurement system of FIG. 17.

FIG. 21 is a plan view showing a method for measuring distances between the tablets from the angle information measured at the tablets T1 to T4 (corresponding to A, B, C and D of FIG. 21) of the position measurement system of the second preferred embodiment. After all the tablets obtain the angle information, the server apparatus calculates the distance information of all the members. In the calculation of the distance information, as shown in FIG. 21, the lengths of all sides are obtained by the sine theorem by using the values of twelve angles and the length of any one side. Assuming that the length of AB is "d", then the length of AC is obtained by the following equation:

$$AC = \frac{d\sin(\theta_{BA} - \theta_{BC})}{\sin(\theta_{CB} - \theta_{CA})}. \quad (1)$$

The lengths of the other sides can be obtained likewise by using the twelve angles and the length d. If each sensor node device can perform the aforementioned time synchronization, each sensor node device can obtain the distance from a difference between the speech start time and the arrival time. Although the number of node devices is four in FIG. 21, the present invention is not limited to this, and the distance between node devices can be obtained regardless of the number of node devices when the number of node devices is not smaller than two.

Although the two-dimensional position is estimated in the above second preferred embodiment, the present invention is not limited to this, and the three-dimensional position may be estimated by using a similar numerical expression.

Further, mounting of sensor node devices on a mobile terminal is described below. Regarding the practical use of the network system, it can be considered to not only use the sensor node devices fixed to a wall and a ceiling but also mounted on a mobile terminal like a robot. If the position of a person to be recognized can be estimated, it is possible to make a robot approach the person to be recognized for image collection of higher resolution and speech recognition of higher accuracy. Moreover, mobile terminals such as smart phones that have been recently rapidly popularized have difficulties in acquiring the positional relations of the terminals at a short distance although they can acquire their own current positions by using the GPS function. However, if the sensor node devices of the present network system are mounted on mobile terminals, it is possible to acquire the positional relations of the terminals that are located at a short distance and unable to be discriminated by the GPS function or the like by performing speech source localization by mutually dispatching speeches from the terminals. In the present preferred embodiment, two types of a message exchange system and a multiplayer hockey game system were mounted as applications that utilize the positional relations of the terminals by using the programming language of java.

In the present preferred embodiment, a tablet personal computer to execute the application and prototype sensor node devices were connected together. A general-purpose OS is mounted as the OS of the tablet personal computer, and a wireless network is configured by having a wireless LAN function compliant to USB2.0 ports in two places and IEEE802.1b/g/n protocol. The prototype sensor node device microphones are arranged at intervals of 5 cm on four sides of the tablet personal computer, and a speech source localization module is operating at the sensor node devices (configured by an FPGA) to output localization results to the tablet personal computer. The position estimation accuracy in the present preferred embodiment is about several centimeters, and the accuracy becomes remarkably higher than that of the prior art.

Third Preferred Embodiment

Figure 22:
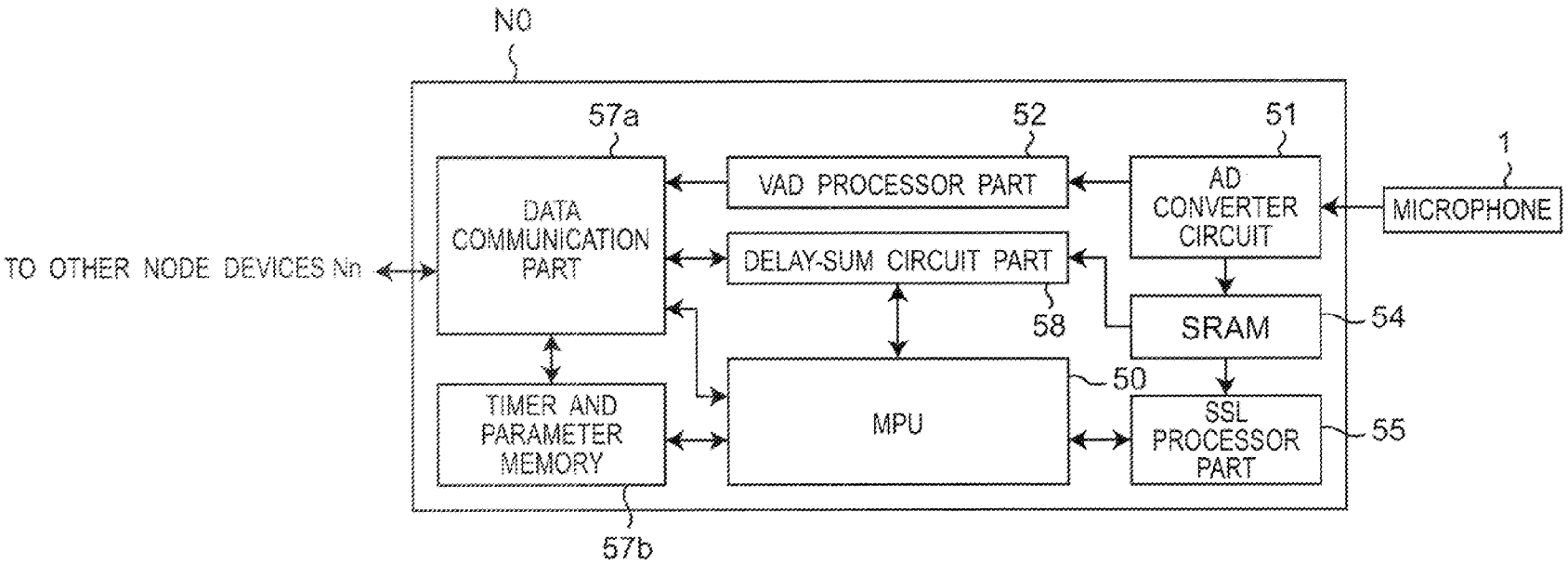
FIG. 22 is a block diagram showing a configuration of the node device of a data aggregation system for a microphone array network system according to a third preferred embodiment of the present invention.
Figure 23:
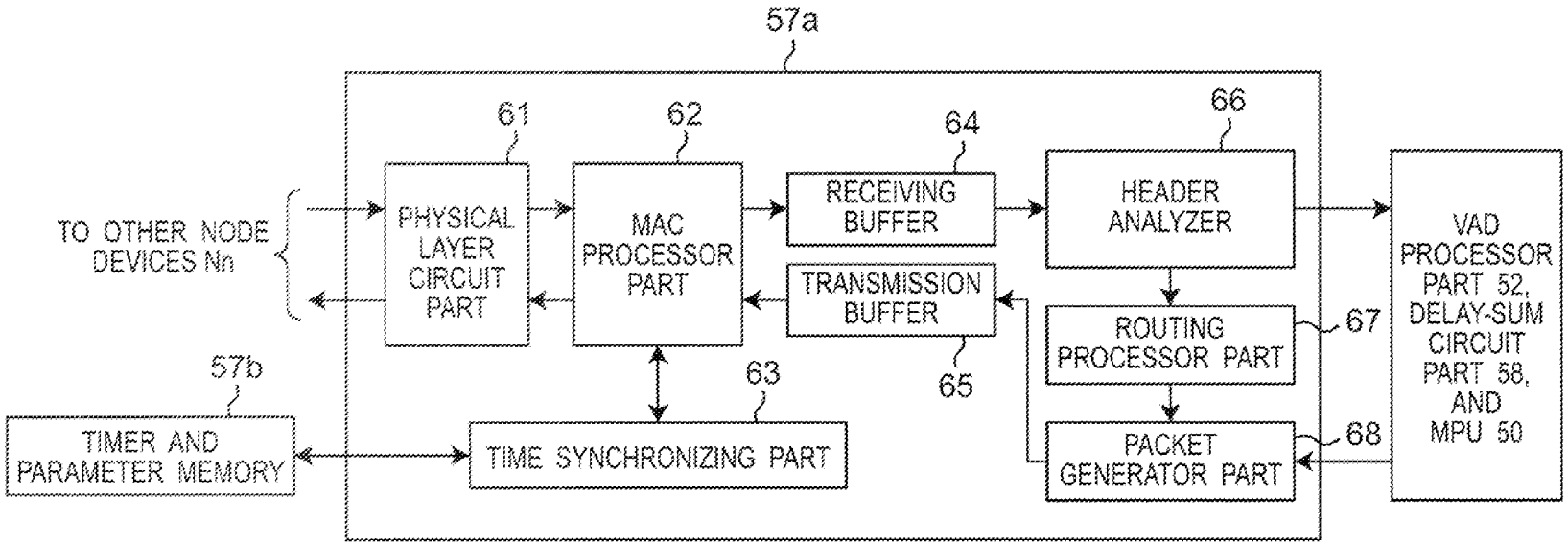
FIG. 23 is a block diagram showing a detailed configuration of the data communication part 57*a* of FIG. 22.

FIG. 22 is a block diagram showing a configuration of the node device of a data aggregation system for a microphone array network system according to the third preferred embodiment of the present invention, and FIG. 23 is a block diagram showing a detailed configuration of the data communication part 57*a* of FIG. 22. FIG. 24 is a table showing a detailed configuration of a table memory in the parameter memory 57*b* of FIG. 23. The data aggregation system of the third preferred embodiment is characterized in that a data aggregation system to efficiently aggregate speech data is configured by using the speech source localization system of the first preferred embodiment and the speech source localization system of the second preferred embodiment. In concrete, the communication method of the data aggregation system of the present preferred embodiment is used as a path formulation technique for a microphone array network system corresponding to a plurality of speech sources. The microphone array network is a technique to obtain a high-SNR speech signal by using a plurality of microphones. By configuring a network by making the technique have a communication function, wide-range high-SNR speech data can be collected. In the present preferred embodiment, by applying this to a microphone array network, an optimal path formulation can be achieved for a plurality of speech sources, allowing sounds from the speech sources to be simultaneously collected. With this arrangement, for example, an audio teleconference system or the like that can cope with a plurality of speakers can be actualized.

Referring to FIG. 22, each sensor node device is configured to include the following:

(1) an AD converter circuit 51 connected to a plurality of microphones 1 for speech pickup;

(2) a VAD processor part 52 connected to the AD converter circuit 51 to detect a speech signal;

(3) an SRAM 54, which temporarily stores speech data of a speech signal and the like including a speech signal or a sound signal that has been subjected to AD conversion by the AD converter circuit 51;

(4) a delay-sum circuit part 58, which executes delay-sum processing for the speech data stored in the SRAM 54;

(5) a microprocessor unit (MPU), which executes sound source localization processing to estimate the position of the speech source for the speech data outputted from the SRAM 54, subjects the results to speech source separation processing (SSS processing) and other processing, and collects high-SNR speech data obtained as the result of the processing by transceiving the data to and from other node devices via the data communication part 57*a;*

(6) a tinier and parameter memory 57*b*, which includes a timer for time synchronization processing and a parameter memory to store parameters for data communications, and is connected to the data communication part 57*a* and the MPU 50; and (7) a data communication part 57*a*, which configures a network interface circuit to transceive the speech data, control packets and so on, and is connected to other peripheral sensor node devices Nn (n=1, 2, . . . , N).

Although the sensor node devices Nn (n=1, 2, . . . , N) have mutually similar configurations, the sensor node device N0 of the base station can obtain speech data whose SNR is further improved by aggregating the speech data in the network.

Referring to FIG. 23, the data communication part 57*a* of FIG. 23 is configured to include the following:

(1) a physical layer circuit part 61, which transceives speech data, control packets and so on, and is connected to other peripheral sensor node devices Nn (n=1, 2, . . . , N);

(2) an MAC processor part 62, which executes medium access control processing of speech data, control packets and so on, and is connected to the physical layer circuit part 61 and a time synchronizing part 63;

(3) a time synchronizing part 63, which executes time synchronization processing with other node devices, and is connected to the MAC processor part 62 and the timer and parameter memory 57*b*, and;

(4) a receiving buffer 64, which temporarily stores the speech data or data of control packets and so on extracted by the MAC processor part 62, and outputs them to a header analyzer 66;

(5) a transmission buffer 65, which temporarily stores packets of speech data, control packets and so on generated by the packet generator part 68, and outputs them to the MAC processor part 62;

(6) a header analyzer 66, which receives the packet stored in the receiving buffer 64, analyzes the header of the packet, and outputs the results to a routing processor part 67 or a VAD processor part 50, a delay-sum circuit part 52, and an MPU 59;

(7) a routing processor part 67, which determines routing as to which node device the packet is to be transmitted on the basis of analysis results from the header analyzer 66, and outputs the result to the packet generator part 68; and (8) a packet generator part 68, which receives the speech data from the delay-sum circuit part 52 or the control data from the MPU 59, generates a predetermined packet on the basis of the routing instruction from the routing processor part 67, and outputs the packet to the MAC processor part 62 via the transmission buffer 65.

Moreover, referring to FIG. 24, the table memory in the parameter memory 57*b* stores:

(1) self-node device information (node device ID and XY coordinates of the self-node device) that has been preparatorily determined and stored;

(2) path information (part 1) (transmission destination node device ID in the base station direction) acquired at time period T11;

(3) path information (part 2) (transmission destination node device ID of cluster CL1, transmission destination node device ID of cluster CL2, . . . , transmission destination node device ID of cluster CLN) acquired at time period T12; and (4) cluster information (cluster head node device ID (cluster CL1), XY coordinates of speech source SS1, cluster head node device ID (cluster CL2), XY coordinates of speech source SS2, . . . , cluster head node device ID (cluster CLN), XY coordinates of speech source SSN) acquired at time periods T13 and T14.

It is assumed that the node devices Nn (n=1, 2, . . . , N) are located on a flat plane and has predetermined coordinates (known) in a predetermined XY coordinate system, and the position of each speech source is measured by position measurement processing.

Figure 25A:
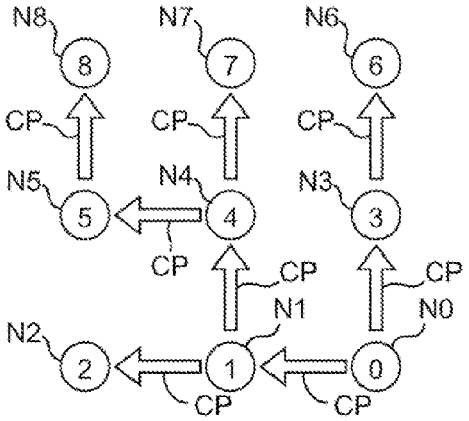
Figure 25B:
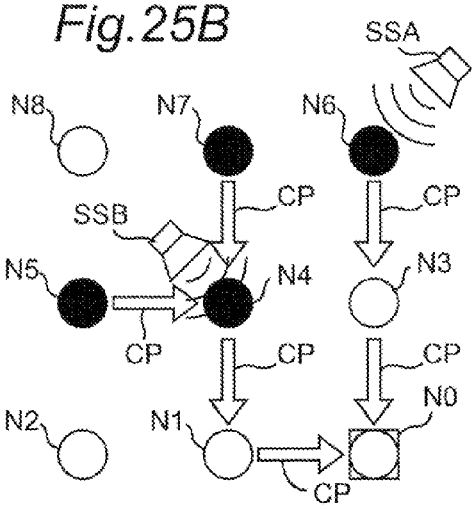
Figure 25C:
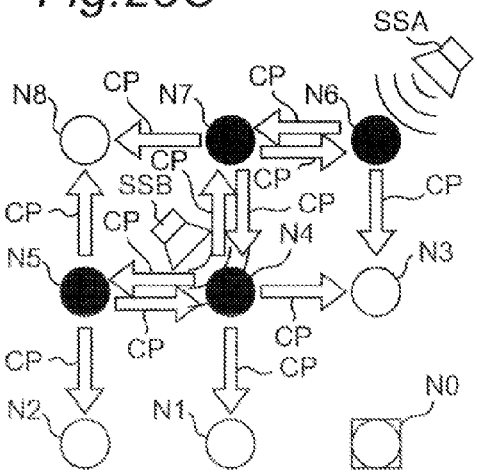
Figure 25D:
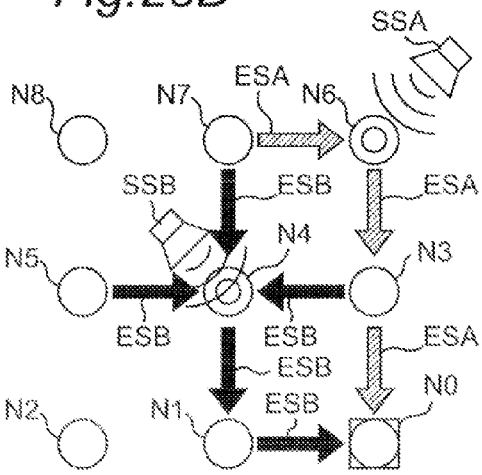
Figure 26A:
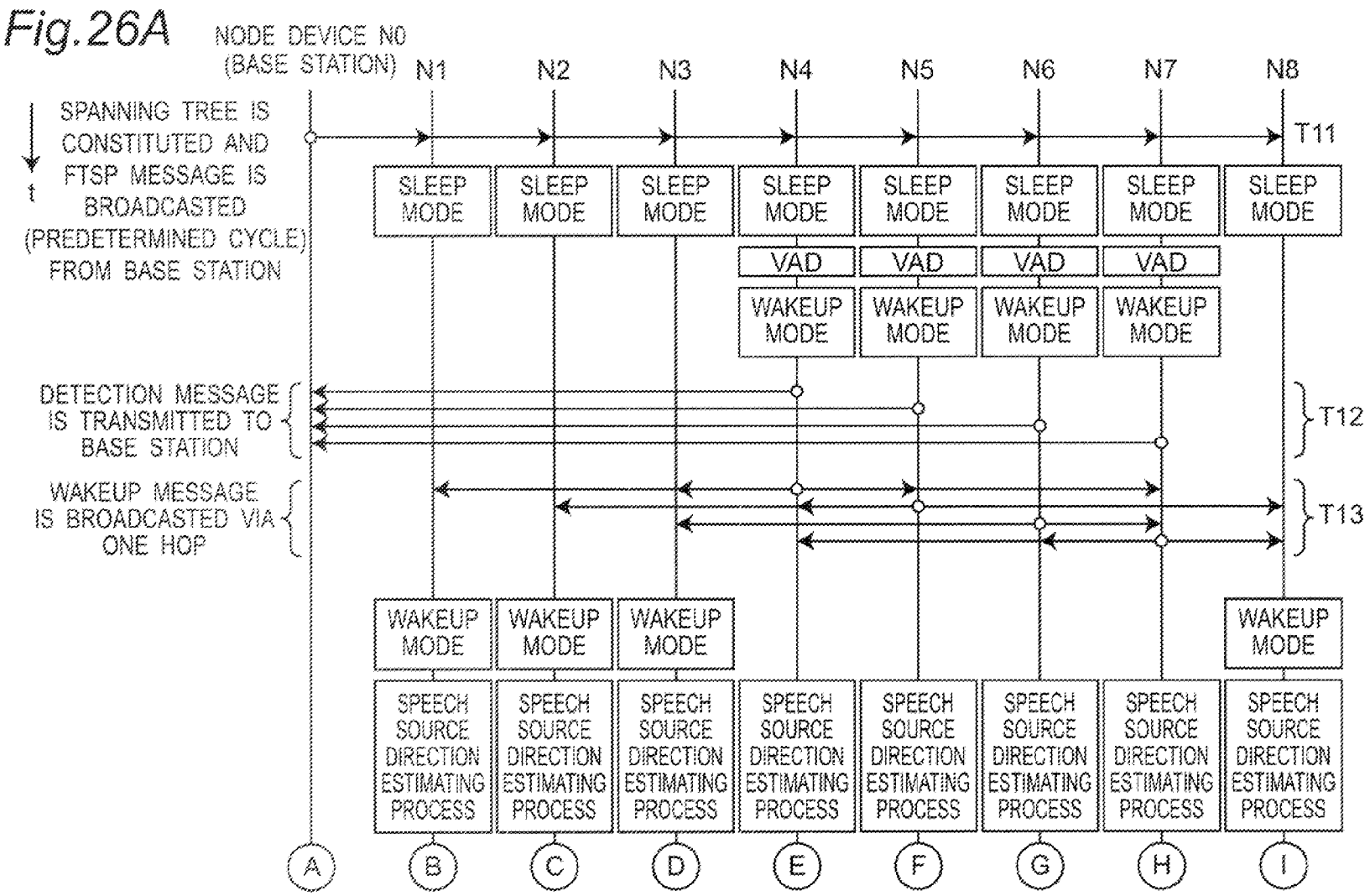
FIG. 26A is a timing chart showing a first part of the processing operation of the data aggregation system of FIG. 22.
Figure 26B:
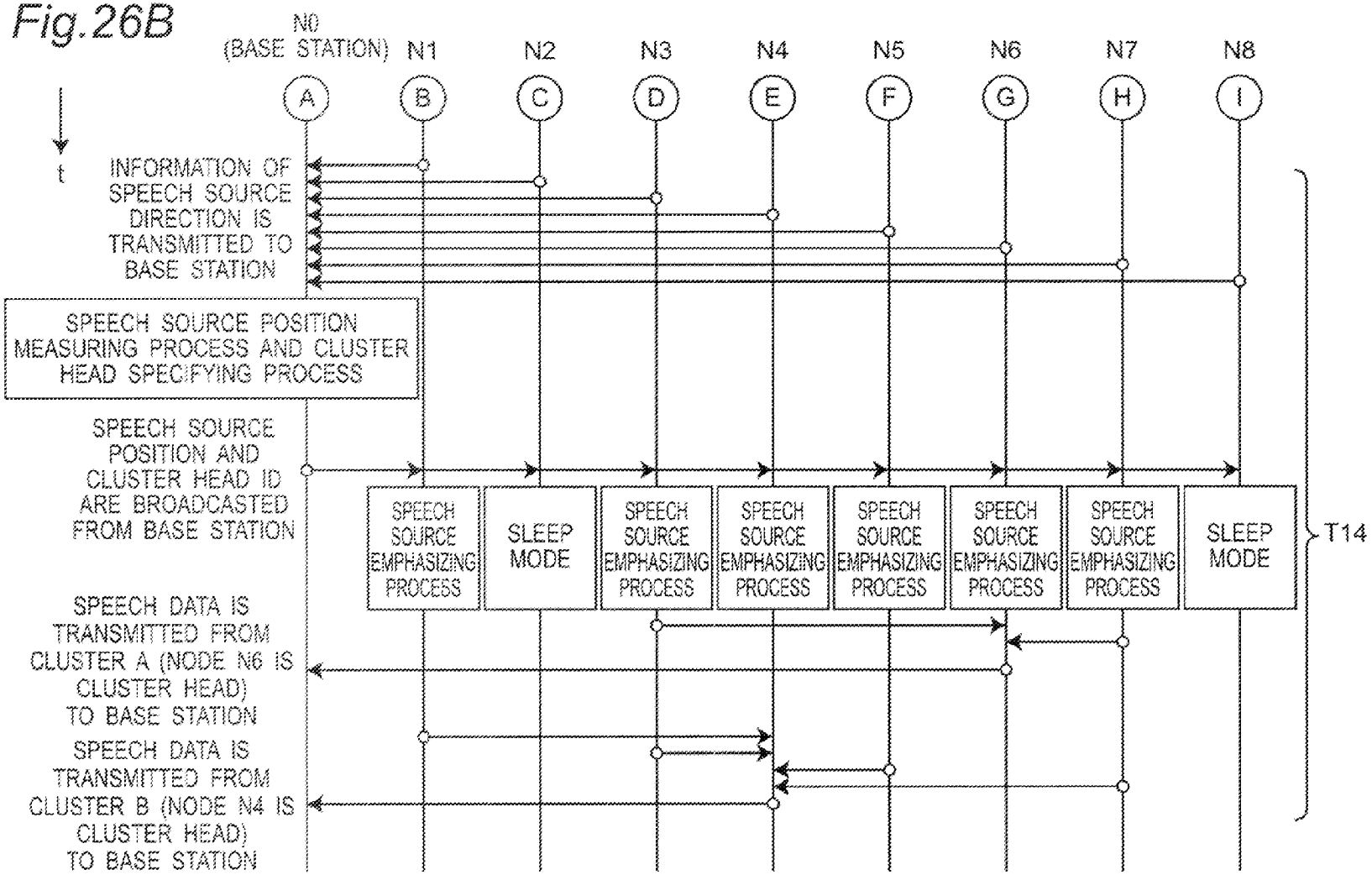
FIG. 26B is a timing chart showing a second part of the processing operation of the data aggregation system of FIG. 22.

FIGS. 25A to 25D are schematic plan views showing processing operations of the data aggregation system of FIG. 22, in which FIG. 25A is a schematic plan view showing FTSP processing from the base station and routing (T11), FIG. 25B is a schematic plan view showing speech activity detection (VAD) and detection message transmission (T12), FIG. 25C is a schematic plan view showing wakeup message and clustering (T13), and FIG. 25D is a schematic plan view showing cluster selection and delay-sum processing (T14). FIGS. 26A and 26B are timing charts showing a processing operation of the data aggregation system of FIG. 22.

In the operation example of FIGS. 25, 26A and 26B, there is shown the example in which one-hop cluster is formed for each of two speech sources SSA and SSB, and speech data are collected into the lower right-hand base station (one node device of a plurality of node devices, indicated by the symbol of a circle in a square) N0 with aggregating and emphasizing the data. First of all, the base station N0 of the microphone array sensor node device performs inter-node device time synchronization and broadcast for collecting path configuration by a spanning tree to the base station every interval of, for example, 30 minutes by using a predetermined FTSP and the NNT (Nearest Neighbor Tree) protocol and simultaneously using a control packet CP (hollow arrow) (T11 of FIGS. 25A and 26A). The node devices (N1 to N8) other than the base station are subsequently set into a sleep mode until a speech input is detected for power consumption saving. In the sleep mode, circuits except for the circuits including the AD converter circuit 51 and the VAD processing part 52 of FIG. 22 and the circuits (physical layer circuit part 61, MAC processor part 62, and the timer and parameter memory 57*b* of data communication part 57*a*) for receiving a wakeup message are not supplied with power, and the power consumption can be remarkably reduced.

Subsequently, when speech signals are generated from the two speech sources SSA and SSB, the node devices (node devices N4 to N7 indicated by black circle in FIGS. 25 and 26) at which the VAD processing part 52 responds upon detecting a speech signal (i.e., utterance) transmit the detected message toward the base station N0 by using the control packet CP through the path of the configured spanning tree (T12 of FIGS. 25B and 26A) and broadcasts a wakeup message for intersecting activation (activation message) by using the control packet CP (T13 of FIGS. 25C and 26A). It is noted at this time that the broadcast range covers a number of hops equivalent to the cluster distance to be configured (one hop in the case of the operation example of FIG. 25). Peripheral sleeping node devices (N1 to N3 and N8) are activated by the wakeup message, and a cluster that centers on the node device at which the VAD processor part 52 responded is formed at the same time.

Subsequently, the node device at which the VAD processor part 52 responded and the node devices (node devices N1 to N8 other than the base station N0 in the operation example) activated by the wakeup message estimate the direction of the speech source by using the microphone array network system, and transmit the results to the base station N0. The path to be used at this time is the path of the spanning tree configured in FIG. 25A. The base station N0 geometrically estimates the absolute position of each speech source by using the method of the position measurement system of the second preferred embodiment on the basis of the speech source direction estimation results of the node devices and the known positions of the node devices. Further, the base station N0 designates the node device located nearest to the speech source among the originating node devices of the detection message as the cluster head node device, and broadcasts the designation result together with the absolute position of the estimated speech source to all the node devices (N1 to N8) of the entire network. If a plurality of speech sources SSA and SSB is estimated, cluster head node devices of the same number as the number of the speech sources is designated. By this operation, a cluster corresponding to the physical location of the speech source is formed, and a path from each cluster head node device to the base station N0 is configured (T14 of FIGS. 25D and 26B). In the operation example of FIGS. 25A to 25D, the node device N6 (indicated by double circle in FIG. 26D) is designated as the cluster head node device of the speech source SSA, and the node devices belonging to the cluster are N3, N6 and N7 within one hop from N6. Moreover, the node device N4 (indicated by double circle in FIG. 26D) is designated as the cluster head node device of the speech source SSB, and the node devices belonging to the cluster are N1, N3, N5 and N7 within one hop from N4. That is, the node devices located within the number of hops from the cluster head node devices N6 and N4 are clustered as the node devices belonging to the respective clusters. Then, the emphasizing process is performed on the basis of the speech data measured at the node devices belonging to each cluster, and the speech data that have undergone the emphasizing process is transmitted to the base station N0. By this operation, the speech data that have undergone the emphasizing process for each of the clusters corresponding to the speech sources SSA and SSB are transmitted to the base station N0 by using packets ESA and ESB. In this case, the packet ESA is the packet to transmit the speech data obtained by emphasizing the speech data from the speech source SSA, and the packet ESB is the packet to transmit the speech data obtained by emphasizing the speech data from the speech source SSB.

Figure 27:
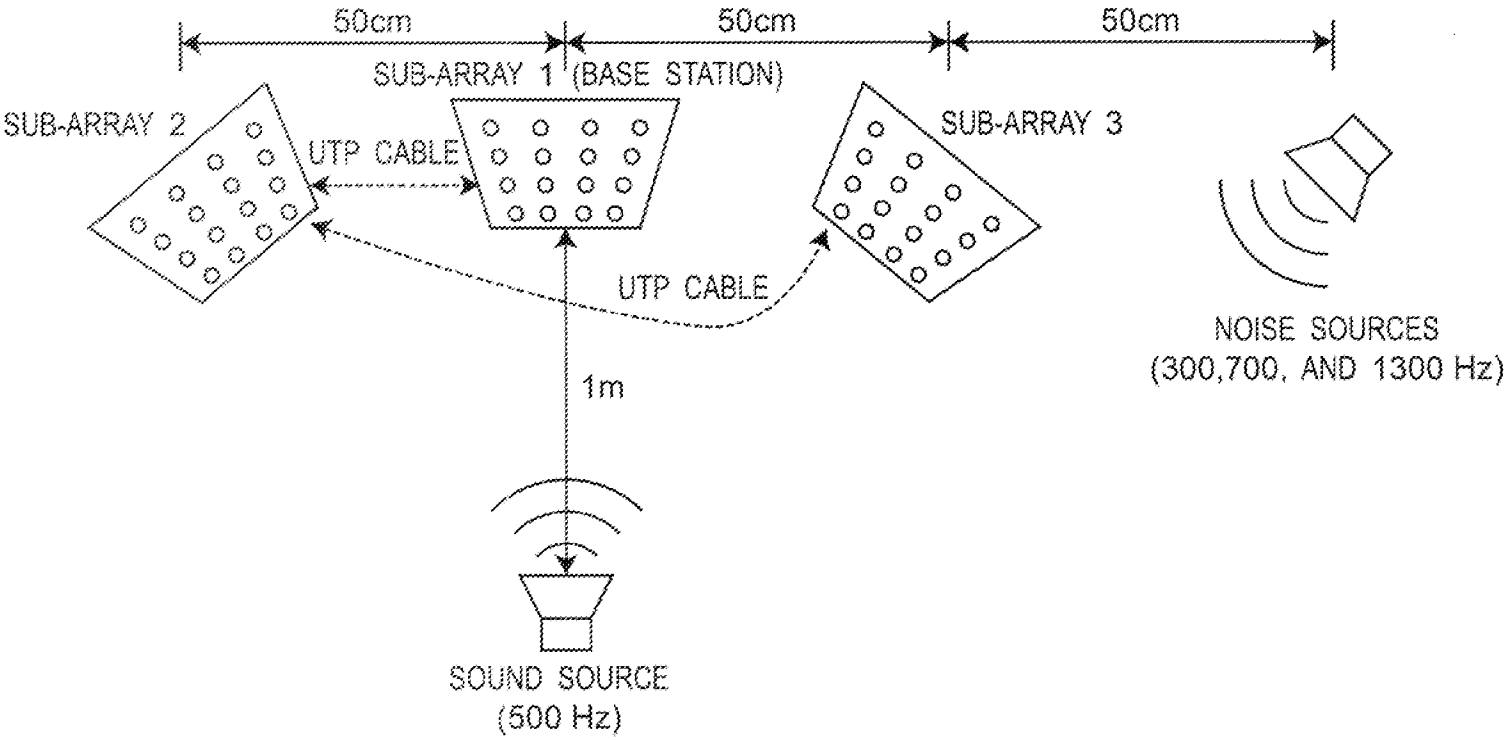
FIG. 27 is a plan view showing a configuration of an implemental example of the data aggregation system of FIG. 22.

FIG. 27 is a plan view showing a configuration of an implemental example of the data aggregation system of FIG. 22. The present inventor and others produced an experimental apparatus by using an FPGA (field programmable gate array) board to evaluate the network of the microphone array of the present preferred embodiment. The experimental apparatus has the functions of a VAD processor part, speech source localization, speech source separation, and a wired data communication module. The FPGA board of the experimental apparatus is configured to include 16-channel microphones 1, and the 16-channel microphones 1 are arranged in a 7.5-cm-interval grid form. The target of the present system is the human speech sound having a frequency range of 30 Hz to 8 kHz, and therefore, the sampling frequency is set to 16 kHz.

In this case, the sub-arrays are connected together by using UTP cables. The 10BASE-T Ethernet (registered trademark) protocol is used as a physical layer. In the data-link layer, the power consumption of the protocol that adopts LPL (Low-Power-Listening) (See, for example, the Non-Patent Document 11) is reduced.

The present inventor and others conducted experiments with three sub-arrays in FIG. 27 in order to confirm the performance of the proposed system. Referring to FIG. 27, three sub-arrays are arranged, and one sub-array 1 located in the center position is connected as a base station to the server PC. In this case, the two-hop linear topology was used to evaluate the multi-hop environment regarding the network topology.

According to the signal waveforms measured after the time synchronization processing, the maximum time lag immediately after completion of the FTSP synchronization processing was 1 μs, and the maximum time lags between sub-arrays with linear interpolation and without linear interpolation were 10 microseconds and 900 microseconds, respectively, per minute.

Subsequently, referring to FIG. 27, the present inventor and others evaluated the data capture of the speech by using the algorithm of the distributed delay-sum circuit part. In this case, as shown in FIG. 27, a signal source of a sine wave at 500 Hz and noise sources (sine waves at 300 Hz, 700 Hz and 1300

Hz) were used. According to the experimental results, the speech signal is enhanced, noises are reduced, and SNR is improved as the microphones are increased in number. Moreover, it was discovered that the noises at 300 Hz and 1300 Hz were drastically suppressed by 20 decibels without deteriorating the signal source (500 Hz) in the condition of 48 channels. On the other hand, the noise at 700 Hz is somewhat suppressed. This is presumably ascribed to the fact that interference was generated depending on the positions of the signal source and the noise source. Moreover, according to another experiment, it was discovered that the noise source at 700 Hz is scarcely suppressed around the positions of the noise source even in the case of 48 channels. This problem is presumably avoidable by increasing the number of node devices. Further, the present inventor and others also confirmed that speech capture could be achieved by using three sub-arrays.

As described above, according to the prior art cluster base routing, clustering has been performed on the basis of only the information of the network layer. On the other hand, in order to configure a path optimized to each signal source in an environment in which a plurality of signal sources of the object of sensing exist in a large-scale sensor network, a sensor node device clustering technique based on the sensing information has been necessary. Accordingly, the method of the present invention has actualized the path formulation more specified for applications by using the signal information (information of the application layer) sensed in cluster head selection and the cluster configuration. Moreover, by combining the method with a wakeup mechanism (hardware) like the VAD processing part 52 in the microphone array network, the power consumption saving performance can be further improved.

Although the sensor network system relevant to the microphone array network system intended for acquiring a speech of a high-quality sound has been described in the aforementioned preferred embodiments, the present invention is not limited to this but allowed to be applied to sensor network systems relevant to a variety of sensors of temperature, humidity, person detection, animal detection, stress detection, optical detection, and the like.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A sensor network system comprising a plurality of node devices each having a sensor array and known position information, the node devices being connected with each other in a network via predetermined propagation paths by using a predetermined communication protocol, the sensor network system collecting data measured at each of the node devices so as to be aggregated into one base station by using a time-synchronized sensor network system, wherein each of the node devices comprises:

a sensor array configured to arrange a plurality of sensors in an array form;

a direction estimation processor part that operates when detecting a signal from a predetermined signal source received by the sensor array on the basis of the signal, to transmit a detected message to the base station and to estimate an arrival direction angle of the signal and transmit an angle estimation value to the base station, and is activated in response to an activation message at a time of detecting a signal received via a predetermined number of hops from other node devices to estimate an arrival direction angle of the signal and transmit an angle estimation value to the base station; and a communication processor part that performs an emphasizing process on a signal from a predetermined signal source received by the sensor array for each of the node devices belonging to a cluster designated by the base station in correspondence with the speech source, and transmits a signal that has undergone the emphasizing process to the base station, wherein the base station calculates a position of the signal source on the basis of the angle estimation value of the signal from each of the node devices and position information of each of the node devices, designates a node device located nearest to the signal source as a cluster head node device, and transmits information of the position of the signal source and the designated cluster head node device to each of the node devices, thereby clustering each of the node devices located within the number of hops from the cluster head node device as a node device belonging to each cluster, and wherein each of the node devices performs an emphasizing process on the signal from the predetermined signal source received by the sensor array for each of the node devices belonging to the cluster designated by the base station in correspondence with the speech source, and transmits the signal that has undergone the emphasizing process to the base station.

2. The sensor network system as claimed in claim 1, wherein each of the node devices is set into a sleep mode before detecting the signal and before receiving the activation message, and power supply to circuits other than a circuit that detects the signal and a circuit that receives the activation message are stopped.

3. The sensor network system as claimed in claim 1, wherein the sensor is a microphone to detect a speech.

4. A communication method for use in a sensor network system comprising a plurality of node devices each having a sensor array and known position information, the node devices being connected with each other in a network via predetermined propagation paths by using a predetermined communication protocol, the sensor network system collecting data measured at each of the node devices so as to be aggregated into one base station by using a time-synchronized sensor network system, wherein each of the node devices comprises:

a sensor array configured to arrange a plurality of sensors in an array form;

a direction estimation processor part that operates when detecting a signal from a predetermined signal source received by the sensor array on the basis of the signal, to transmit a detected message to the base station and to estimate an arrival direction angle of the signal and transmit an angle estimation value to the base station and is activated in response to an activation message at a time of detecting a signal received via a predetermined number of hops from other node devices to estimate an arrival direction angle of the signal and transmit an angle estimation value to the base station; and a communication processor part that performs an emphasizing process on a signal from a predetermined signal source received by the sensor array for each of the node devices belonging to a cluster designated by the base station in correspondence with the speech source, and transmits a signal that has undergone the emphasizing process to the base station, and wherein the communication method including the following steps:

calculating by the base station a position of the signal source on the basis of the angle estimation value of the signal from each of the node devices and position information of each of the node devices, designating a node device located nearest to the signal source as a cluster head node device, and transmitting information of the position of the signal source and the designated cluster head node device to each of the node devices, thereby clustering each of the node devices located within the number of hops from the cluster head node device as a node device belonging to each cluster, and performing an emphasizing process by each of the node devices on the signal from the predetermined signal source received by the sensor array for each of the node devices belonging to the cluster designated by the base station in correspondence with the speech source, and transmitting the signal that has undergone the emphasizing process to the base station.

5. The communication method as claimed in claim 4, further including a step of setting each of the node devices into a sleep mode before detecting the signal and before receiving the activation message, and stopping power supply to circuits other than a circuit that detects the signal and a circuit that receives the activation message.

6. The communication method as claimed in claim 4, wherein the sensor is a microphone to detect a speech.

* * * * *